United States Patent [19]

Satomura et al.

[11] Patent Number: 4,674,857

[45] Date of Patent: Jun. 23, 1987

[54] IMAGE RECORDING APPARATUS

[75] Inventors: Hiroshi Satomura, Hatogaya; Tatsuo Takeuchi, Tokyo; Hidemi Egami, Zama; Yukio Nagase, Tokyo; Nagao Hosono, Hachiohji, all of Japan

[73] Assignee: Canon Kabushiki Kaisha, Tokyo, Japan

[21] Appl. No.: 782,908

[22] Filed: Oct. 2, 1985

[30] Foreign Application Priority Data

| | | | |
|---|---|---|---|
| Oct. 5, 1984 | [JP] | Japan | 59-209144 |
| Oct. 5, 1984 | [JP] | Japan | 59-209147 |
| Aug. 30, 1985 | [JP] | Japan | 60-191413 |
| Aug. 30, 1985 | [JP] | Japan | 60-191414 |

[51] Int. Cl.[4] ..... G03G 15/00

[52] U.S. Cl. ..... 355/3 R; 355/3 TE; 355/3 TR; 355/24; 355/25

[58] Field of Search ..... 355/24, 23, 3 R, 3 BE, 355/16, 3 TR, 14 R, 3 TE

[56] References Cited

U.S. PATENT DOCUMENTS

| | | | |
|---|---|---|---|
| 3,775,102 | 11/1973 | Punnett | 355/24 X |
| 4,186,662 | 2/1980 | Borneman | 355/24 X |
| 4,427,285 | 1/1984 | Stange | 355/24 X |
| 4,579,446 | 4/1986 | Fujino et al. | 355/24 |

*Primary Examiner*—A. C. Prescott

*Attorney, Agent, or Firm*—Fitzpatrick, Cella, Harper & Scinto

[57] ABSTRACT

An image recording apparatus includes a rotatable transfer member and a plurality of latent image bearing members which are in rolling press-contact with the transfer member at different positions. Around the latent image bearing members, are provided latent image forming devices and devices for developing the latent image. The developed images formed on the respective latent image bearing members are transferred by pressure onto a recording material or onto the transfer member at the respective nips formed between the transfer member and one of the latent image bearing members. With this apparatus, duplex image recording, overprint or superimposing recording, and/or high speed recording can be accomplished.

16 Claims, 40 Drawing Figures

IMAGE RECORDING APPARATUS

FIELD OF THE INVENTION AND RELATED ART

The present invention relates to an image recording apparatus, and more particularly, to an image recording apparatus wherein a latent image is formed on a latent image bearing member through an electrostatic recording or electrophotographic process and is developed into a visualized image, which is then transferred by pressure to form a recorded image.

Various types of systems exist for use as an image recording apparatus for recording a desired image on a recording material in response to an electric image signal. Among those, a printer using an electrophotographic process (which hereinafter will be called, exemplarily, a "laser beam printer") is advantageous in that it can record at a high speed, that the printing can be effected on plain paper, that the noise is low and that the reliability is high; and therefore, it has recently become representative of nonimpact printers.

FIG. 1 is a perspective view of such a laser beam printer, wherein the reference numeral 1 designates a semiconductor laser generator for generating a laser beam. It produces a laser beam modulated with an image signal. The modulated laser beam is reformed by a beam expander 3 into a beam having a predetermined diameter. Then, the laser beam is incident on a polygonal mirror 4, which comprises a plurality of reflecting mirrors and is rotated at a predetermined constant speed by a constant speed motor 5. The beam is imaged as a spot on a photosensitive drum 2 by an imaging lens 6 having a so-called f-$\theta$ characteristics. The photosensitive drum 2 may have a photosensitive layer of amorphous silicon or OPC (organic photoconductor) or amorphous selenium of improved sensitivity to long wavelength light, or the like.

The surface of the photosensitive drum 2 is uniformly charged by a charger 7 and is scanned by the modulated laser beam so that an electrostatic latent image is formed thereon. The electrostatic latent image is developed by a developing device 8 into a visualized image, which is in turn transferred by a transfer charger 10 onto a transfer material 9. The transfer material is then separated from the photosensitive drum 2 by a separation charger 11. The image transferred on the transfer material 9 is fixed into a permanent image on the transfer material 9 by an image fixing device 12.

Recently, there has been a demand, with respect not only to copying machines but also to printers of this type, for an overprinting capability such that an additional image can be recorded on an already recorded or printed surface, and for a duplex recording, such that images can be recorded on both sides of a recording material.

FIG. 2 illustrates an example of a laser beam printer which is capable of effecting duplex printing and overprinting. The recording material on one side of which the image has been formed in the process described with regard to FIG. 1, that is, the transfer material which has passed through the fixing device 12, is transported to a passage leading to the passage 16 or the passage 17 by a pawl 15 which operates in response to the duplex recording mode or the overprint recording mode being selected. The selection between the passage 16 and the passage 17 is determined by the pawl 18. If the duplex recording mode has been selected, the transfer material is transported along the passage 16, whereas if the overprint recording mode has been selected, the transfer material is transported along the passage 17. Then, the transfer material is transported along the passage 20 by operation of the feeding rollers 19 to the transfer station where another image developed on the photosensitive drum 2 is transferred by the transfer charger 10 onto the same or the other side of the transfer material, so that a duplex print or an overprint is provided. Then, the transfer material is separated from the photosensitive drum 2 by a separation charger 11, and the second image is fixed by the same fixing device 12.

As will be understood from the foregoing, the duplex or overprint recording in the electrophotograpic type printer involves the following drawbacks:

1. The passage for the transfer material is long, with the result that the device is bulky, and therefore, that the transfer material is more frequently jammed;
2. The image transfer operation or the transfer material separation may relatively easily fail because of unavoidable stains on the transfer charger or the separation charger, which requires periodical maintenance of the chargers at short intervals; and
3. Because of the lengthy passage of the transfer material, the time required for duplex or overprint recording is long.

SUMMARY OF THE INVENTION

Accordingly, it is a principal object of the present invention to provide an image recording apparatus wherein the passage for the transfer material is simplified, and duplex recording is possible.

It is another object of the present invention to provide an image recording apparatus wherein the passage for the transfer material is simplified, and overprint recording is possible.

It is another object of the present invention to provide an image recording apparatus by which a high speed recording is possible.

According to the present invention, the foregoing objects are attained by providing an image forming apparatus having first and second movable (preferably rotatable) latent image bearing members, means for forming latent images thereon and means for developing the latent images so formed. Two such latent image forming means and developing means may be provided. A means for transferring the developed images is also provided. According to one aspect of the invention, the transferring means is common to the first and second latent image bearing members. According to another aspect, the transfer means includes first and second rotatable transfer members, the first of which forms first and second nips with the first and second latent image bearing members, respectively, and the second forms a third nip, with the second latent image bearing member. According to the first aspect of the invention, a single transfer means is capable of performing image transfer from each of several latent image bearing members, making possible high speed recording, as well as various modes of printing, while having a simple structure. According to the second aspect mentioned, provision of the three nips as so defined makes possible both high speed recording and various modes of printing, again using a simple structure.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 3:
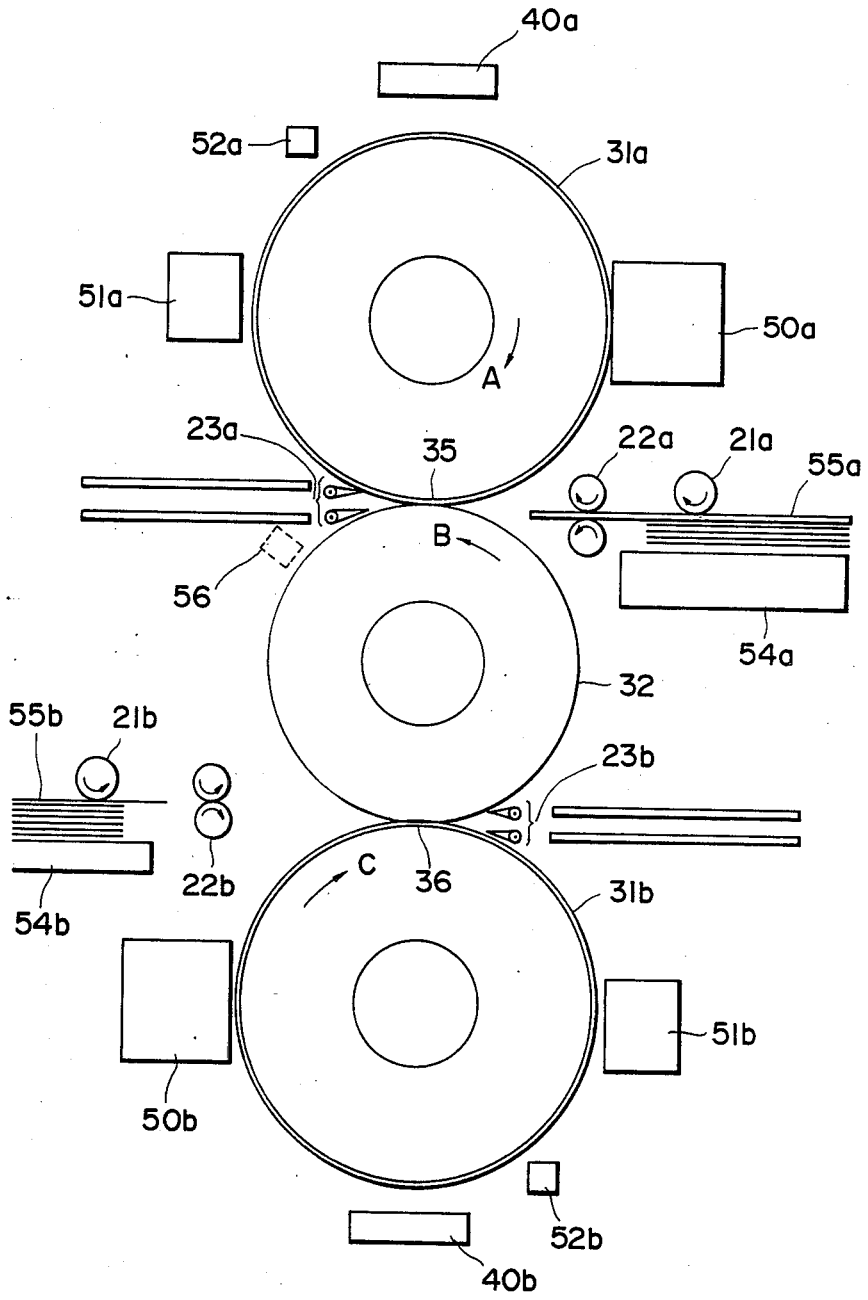
FIG. 3 is a sectional view of a basic structure of an image recording apparatus for various embodiments of the present invention.

Referring now to FIG. 3, there is shown an image recording apparatus in cross-section according to the present invention. The image recording apparatus comprises latent image bearing members in the form of rotatable dielectric members, more particularly, first and second dielectric drums 31*a* and 31*b*. The apparatus further comprises a transfer rotatable member in the form of a transfer roller 32 which is in rolling press-contact with the dielectric drum 31*a* and the dielectric drumm 31*b* at different positions so as to form nips 35 and 36 adjacent the areas of press-contact. The dielectric drum 31*a*, the transfer roller 32 and the dielectric drum 31*b* are rotatable in the directions indicated by the arrows beside reference characters A, B and C, respectively, at the same peripheral speed. Each of the dielectric drums 31*a* and 31*b* has a rigid cylinder provided with a surface layer of dielectric material having a volume resistivity of approximately $10^{12}$ ohm.cm and having a thickness of several tens of microns. The transfer roller 32 comprises a rigid cylinder provided with a surface layer of a synthetic resin having compressive resiliency. More particularly, the dielectric drums 31*a* and 31*b* in this embodiment each comprise an aluminum cylinder provided with a surface layer of epoxyacrylate resin including fluorocarbon resin having a thickness of approximately 20 microns. The transfer roller in this embodiment comprises a steel roller provided with polyacetal resin having a thickness of 5 mm and having a compressive elastic modulus of 320 kg/mm$^2$. The surface roughness of the dielectric drums is 0.06 $\mu$rmS, and that of the transfer roller is 0.5 $\mu$rmS.

In this embodiment, the first dielectric drum 31*a* and the second dielectric drum 31*b* have the same diameter, but this is not absolutely necessary. The transfer roller 32 is indicated as having a diameter smaller than that of the dielectric drums 31*a* and 31*b*, but it may be larger. If it is larger, more than three dielectric drums may be combined with a single transfer roller 32. Around the dielectric drum 31*a*, there are provided a recording head 40*a* functioning as an electrostatic recording means for repeatedly forming images on the surface of the dielectric drum 31*a*, a developing device 50*a* for developing the latent image formed by recording head, a cleaning device 51*a* and a discharger 52*a*. Those elements will be described in detail in the following.

Figure 4:
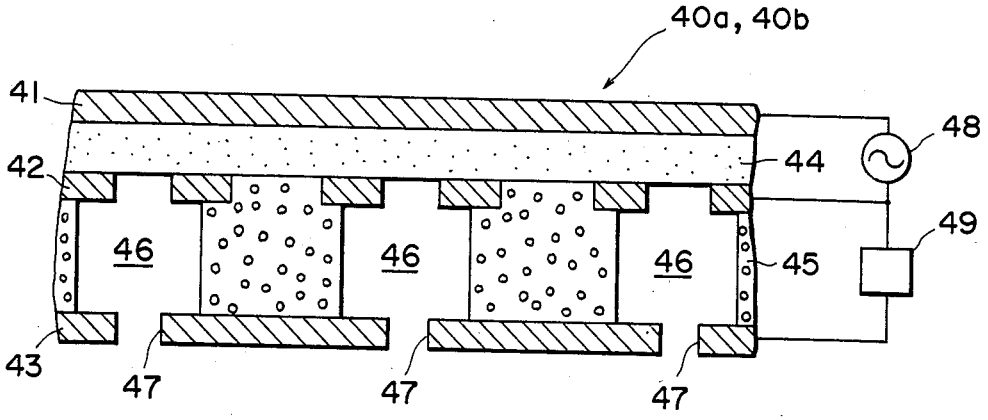
FIG. 4 is a longitudinal sectional view of an example of a recording head usable with an image recording apparatus according to the present invention.

FIG. 4 is a sectional view of the electrostatic recording head 40*a*, which produces ions at a high current density, which ions are selectively extracted and deposited on the surface of the dielectric drum 31*a* so that the dielectric drum 31*a* is charged imagewise. The recording head 40*a* comprises first electrodes in the form of inducing electrodes 41 extending in a first direction (the lateral direction of the sheet of drawings of FIG. 4) and second electrodes in the form of discharging electrodes (finger electrodes) 42 extending in a second direction which is different from the first direction. Those electrodes constitute a matrix. The side of the second electrodes 42 which is remote from the first electrodes 41 is provided with third electrodes 43, which are provided with a plurality of fine apertures 47 corresponding to cross-points of the matrix. The first electrodes 41 and the second electrodes 42 have interposed therebetween a first dielectric member 44. The second electrode 42 and the third electrode 43 have interposed therebetween a second dielectric member 45. The second dielectric member 45 is provided with plural apertures 46 corresponding to the plural apertures 47 of the third electrode 43. When alternating voltage is selectively applied from the alternating voltage applying means 48 between the first electrodes 41 and the second electrodes 42 of the recording head, positive and negative ions are produced adjacent the second electrodes 42 at the positions corresponding to the selected cross-point of the matrix. A bias voltage is applied between the second electrodes 42 and the third electrodes 43 by the bias voltage applying means 49, and ions whose polarity depends on the polarity of the bias voltage are extracted from the generated positive and negative ions, and are moved through the apertures 46 and the apertures 47 to the surface of the dielectric drum 31*a* to electrically charge it. Thus, by selectively driving the plural first electrodes 41 and second electrodes 42, the electrostatic recording is performed. The driving may be based on the output of an electronic computer or on the output of a CCD (charge coupled device) representing an image read thereby. For the recording head, the one disclosed in U.S. Pat. No. 4,160,257 may be used. Additionally, a conventional recording head may be used which is of the type having needle electrodes such as multi-stylus.

Downstream of the recording head 40*a* with respect to the direction of rotation of the first dielectric drum 31*a*, is the developing device 50*a* which may be of the type known in the field of electrophotography. In this embodiment, toner consisting mainly of polyethylene resin is used. At the nip 35, the dielectric drum 31*a* and the transfer roller 32 are press-contacted to each other. A recording material which is in the form of a recording sheet in this embodiment is transported from a supply tray 54*a* which functions as the recording material supplying means to the first nip 35 by feeding rollers 21*a*. Designated by the reference numeral 22*a* is a registration roller which is known in the field of electrophotography. The recording sheet 55*a* may be made of paper, cloth, plastic or the like material.

Downstream of the first nip 35 is the cleaning means 51*a* which is effective to remove the developer remaining on the surface of the dielectric drum 31*a* after the image transfer. The cleaning device 51*a* may be of the type known in the field of electrophotography. However, the device of the type of this embodiment has a higher efficiency of image transfer than that of electrophotographic apparatus using a transfer charger, so that it is not always necessary to employ the cleaning means, and that good images can be provided without the cleaning device.

A discharger 52*a* is provided downstream of the cleaning device 51*a*. The discharger 52*a* is effective to remove the electric charge remaining on the surface of the dielectric drum 31*a* after the cleaning by the cleaning device 51*a*.

Separation pawls 23*a* are provided adjacent to the dielectric drum 31*a* and to the transfer drum 32, respectively. The pawls 23*a* serve to separate the recording sheet from the dielectric drum 31*a* and from the transfer roller 32 or to cause the transfer drum 32 to carry the recording sheet without separation therefrom.

In operation, a latent image is formed by the recording head 40*a* on the dielectric drum 31*a* surface and is developed by the developing means 50*a* into a developed image, which is in turn transferred by pressure onto the recording sheet 55*a* or onto the transfer roller 32 at the first nip 35, which will be described in detail hereinafter. After the image transfer, the dielectric drum 31*a* is cleaned by the cleaning device 51*a* whereby the remaining developer is removed from the drum 31*a*. Thereafter, the dielectric drum 31*a* is electrically discharged by the discharger 52*a*.

The second dielectric drum 31*b* is below the transfer roller 32 in the Figure and is in rolling press-contact with the transfer roller 32 at the second nip 36. Around the second dielectric drum 31*b*, there are provided various means which are the same as those described with respect to the first dielectric drum 31*a*. The structure and operation of those elements are similar to those with the first dielectric drum 31*a*, and therefore, the detailed description thereof is omitted, while similar reference numerals with suffix "b" in place of "a" are used to designate the corresponding means. It is to be added that some embodiments do not need to employ one of the supply trays, for example, the supply tray 54*b*, which will become apparent from the description hereinafter.

The dielectric drum 31*a*, the transfer roller 32 and the dielectric drum 31*b* are resiliently displaceably supported so as to make smoother the insertion of the recording sheet in to the nips. In this embodiment, the pressure at the nips is 50 kg/cm$^2$.

Various embodiments of the image recording apparatus according to the present invention will be described further in detail. In the Figures used with the following decriptions, the recording head, the developing device, the cleaning device, the discharger and so on are omitted since they are the same as with the FIG. 3 structure.

Figures 5A, 5B, 5C:
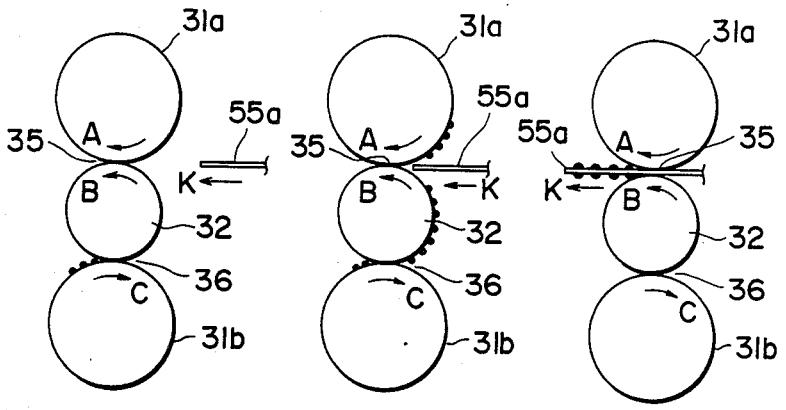
FIGS. 5A, 5B and 5C.

FIGS. 5A, 5B and 5C illustrate a first embodiment, wherein the detailed structures are the same as with FIG. 3 structure with the exception of means specifically mentioned.

In this embodiment, the duplex recording can be effected, wherein image is are simultaneously recorded on both sides of the recording sheet.

The dielectric drums 31*a* and 31*b* and the transfer roller are rotated in the directions of the arrows A, B and C at the same peripheral speed. The lower (second) recording head 40*b* first starts operating to form an electrostatic latent image on the lower dielectric drum, that is, the second dielectric drum 31*b*. The electrostatic latent image is developed by the developing device 50*b* so that a first developed image is formed on the second dielectric drum 31*b*. The first image is an image to be recorded on the backside, for example, of the recording sheet 55*a*. The developed image reaches the second nip 36 with the continued rotation of the second dielectric drum 31*b*, as shown in FIG. 5A and is transferred onto the transfer roller 32. The image now on the transfer roller 32 reaches the first nip 35 with the continued rotation of the transfer roller 32 (FIG. 5B).

On the other hand, the upper recording head 40*a* starts, with a predetermined delay of time from the start of the other (second) head 40*b* operation, operating to form a (second) electrostatic latent image on the upper dielectric drum, that is, the first dielectric drum 31*a*. The electrostatic latent image is developed by the developing device 50*a* so that a second developed image is formed on the first dielectric drum 31*a*. The second image is, for example, an image to be recorded on the other side, that is, the front side of the recording sheet 55*a*. The developed image reaches the first nip 35 with the continued rotation of the first dielectric drum 31*a*.

Into the first nip 35, the recording sheet 55*a* is fed out of the supply tray 54*a* in the direction indicated by an arrow K. During the passage of the recording sheet through the first nip 35, the first and second development images are transferred from the first dielectric drum 31*a* and from the transfer drum 32 onto the front side of the recording sheet and onto the back side thereof, respectively.

In this manner, the front and back sides of the recording sheet 55*a* simultaneously receive the respective images in this embodiment. The start of the operation of the upper recording head 40*a*, that of the lower recording head 40*b* and the sheet feeding to the first nip 35 are so timed that each of the images is formed at the proper position of the recording sheet 55*a*.

As will be readily undersood, this embodiment does not require the second supply tray 54*b*. Inversely, only the second supply tray 54*b* may be used so that the images are transferred at the second nip 36.

Figure 6A:
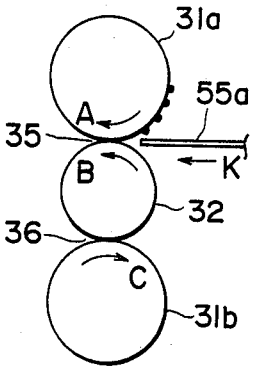
FIGS. 6A, 6B and 6C.
Figure 6B:
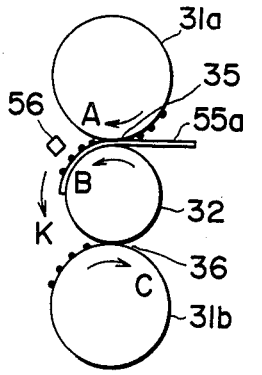
Figure 6C:
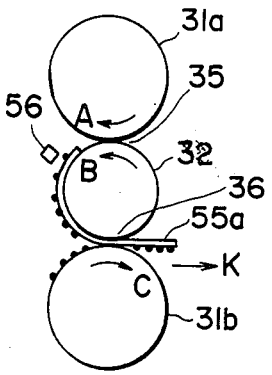

FIGS. 6A, 6B and 6C illustrate another embodiment of the present invention, wherein overprint recording can be effected, in which an image is recorded on an already printed or recorded side of a recording sheet.

The dielectric drums 31*a* and 31*b* and the transfer roller 32 are rotated in the directions of arrows A, B and C at the same peripheral speed. The upper (first) recording head 40*a* starts operating to form an electrostatic latent image on the upper dielectric drum, that is, the first dielectric drum 31*a*. The electrostatic latent image is developed by the developing device 50*a* so that a first developed image is formed on the first dielectric drum 31*a*. This image is an image to be recorded on the front side, for example, of the recording sheet 55*a*. The developed image reaches the first nip 35 with the continued rotation of the first dielectric drum 31*a* as shown in FIG. 6A, and is transferred by pressure onto the recording sheet 55*a* fed thereto in the direction of arrow K in timed relation with the leading edge of the developed image (FIG. 6B).

In this embodiment, the recording sheet 55*a* is gripped by or attracted to and supported on the transfer roller 32 by a device 56 for mechanically or electrostatically holding and supporting the recording sheet 55*a* on the transfer drum 32. Thus, the recording sheet 55*a* is carried on the surface of the transfer roller 32 during the rotation thereof.

The lower (second) recording head 40*b* starts, with a predetermined delay of time from the start of the other (first) head 40*a* operation, operating to form an electrostatic latent image on the lower dielectric drum, that is, the second dielectric drum 31*b*. The electrostatic latent image is developed by the developing device 50*b* so that a second developed image is formed on the second dielectric drum 31*b*. This image is an image to be recorded superimposedly on the same side, that is, the front side of the recording sheet 55*a* in this embodiment. The developed image reaches the second nip 36 with the continued rotation of the second dielectric drum 31*b*, as shown in FIG. 6B.

Into the second nip 36, the recording sheet 55*a* carried on or wrapped around the transfer roller 32 is fed by the continued rotation of the transfer roller 32. During the passage of the recording sheet 55*a* through the second nip 36, the front side of the recording sheet 55*a* already having the first transferred image on that side, receives by the pressure-transfer the second developed image from the second dielectric drum 31*b*.

In this manner, two superposed images are recorded on one side of the recording sheet 55*a*.

The start of operation of the upper recording head 40*a*, that of the lower recording head 40*b* and the sheet feeding to the first nip 35 are so timed that each of the images is formed at the proper position of the recording sheet 55*a*.

As will be readily understood, this embodiment does not require the second supply tray 54*b*. Inversely, only the second supply tray 54*b* may be used, so that the images are superimposedly transferred at the second nip 36.

As for a modification of this embodiment, the color of the first developing device 50*a* and that of the second developing device 50*b* may be made different so that the overprint recording may be effected in two colors.

Figure 7A:
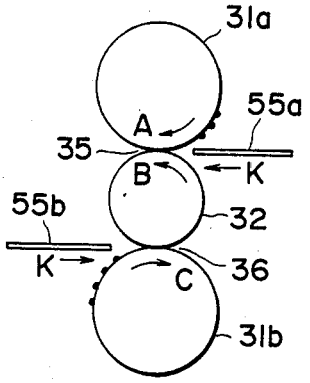
FIGS. 7A, 7B and 7C, and FIGS. 8A, 8B and 8C illustrate four embodiments of the present invention, based on the structure shown in FIG. 3.
Figure 7B:
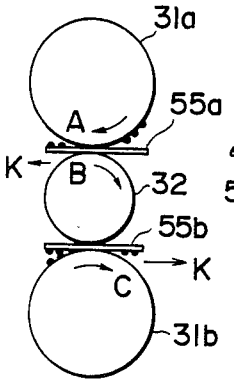
Figure 7C:
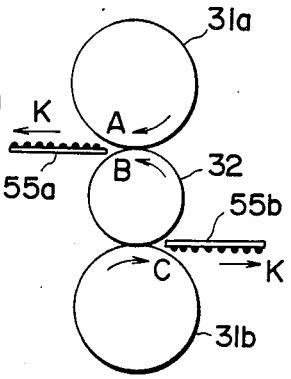

FIGS. 7A, 7B and 7C illustrate the third embodiment of the present invention, wherein the same or different images are simultaneously recorded on two recording sheets 55*a* and 55*b*. The dielectric drums 31*a* and 31*b* and the transfer roller 32*a* are rotated in the directions of the arrows A, B and C at the same peripheral speed.

The upper (first) recording head 40*a* operates to form an electrostatic latent image on the upper dielectric drum, that is, the first dielectric drum 31*a*. The electrostatic latent image is developed by the developing device 50*a* so that a first developed image is formed on the first dielectric drum 31*a*. The image is an image to be recorded on one side, of a first recording sheet 55*a*. The first developed image reaches the first nip 35 with the continued rotation of the first dielectric drum 31*a*, as shown in FIG. 7A, where the developed image is transferred by pressure onto the one side (the top side in the Figure) of the first recording sheet 55*a* fed in the direction of arrow K in timed relation for alignment with the leading of the image on the first dielectric drum 31*a* (FIG. 7B).

In parallel with the above operations, the lower (second) recording head 40*b* operates to form an electrostatic latent image on the lower dielectric drum, that is, the second dielectric drum 31*b*. The second electrostatic latent image is developed by the developing device 50*b* so that a second developed image is formed on the second dielectric drum 31*b*. The image is an image to be recorded on one side of the second recording sheet 55*b*. The second developed image reaches the second nip 36 with the continued rotation of the second dielectric drum 31*b*, as shown in FIG. 7A, where the second developed image is tranferred by pressure onto the one side, (the bottom side in the Figure) of the second recording sheet 55*b* fed in the direction of arrow K in timed relation for alignment with the leading edge of the second image on the second dielectric drum 31*b*. In this manner, the recording on the two recording sheets 55*a* and 55*b* is simultaneously performed at the respective nips 35 and 36 so that the record processing capability is raised and the overall recording speed is increased.

In the typical mode of operation, the recording heads 40*a* and 40*b* are operated simultaneously, and the recording sheets 55*a* and 55*b* are fed out to the respective nips 35 and 36, simultaneously. However, it is possible that both of the drums 31*a* and 31*b* and the transfer roller 32 are continuously rotated, and the recording head 40*a* and the recording head 40*b* are driven without timed relation therebetween. In this case, the recording sheets are fed out at the different points of time so that they are properly timed with the operations of the respective recording heads. In this manner, the respective recording heads may be operated independently from each other. Even in this case, the recording process capability is improved since the recording operations are effected in the two positions.

The information to be recorded by the first recording head 40*a* and that by the second recording head 40*b* may be the same or different.

Figure 8A:
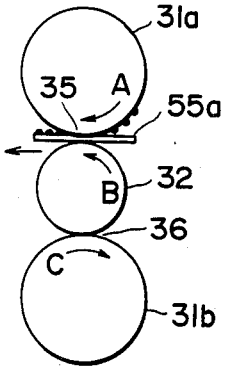
Figure 8B:
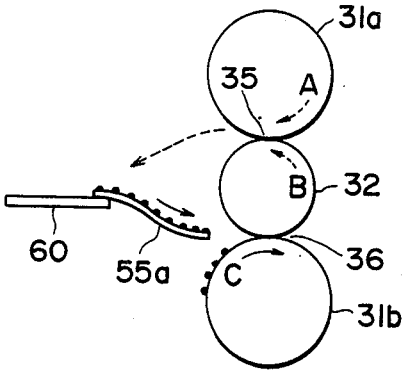
Figure 8C:
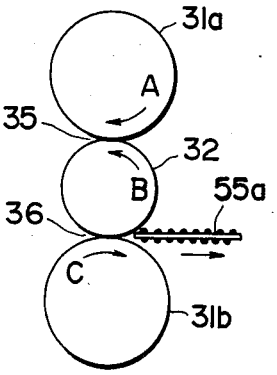

FIGS. 8A, 8B and 8C illustrate a fourth embodiment, wherein duplex recording can be effected.

The drums 31*a* and 31*b* and the transfer roller 32 are rotated in the directions of arrows A, B and C at the same peripheral speed. The upper recording head 40*a* operates to form an electrostatic latent image on the upper dielectric drum 31*a*, that is, the first dielectric drum 31*a*. The electrostatic latent image is developed by the developing device 50*a* so that a first developed image is formed on the first dielectric drum 31*a*. The image is an image to be recorded on the front side, for example, of the recording sheet 55*a*. The developed image reaches the first nip 35 with the continued rotation of the first dielectric drum 31*a*, as shown in FIG. 8A, where the developed image is transferred by pressure onto the recording sheet 55*a* fed in the direction of arrow K in timed relation for alignment with the leading edge of the image.

The recording sheet 55*a* now having the image on the front side thereof passes through the first nip 35 and arrives at a switch-back mechanism 60, as shown in FIG. 8B where the recording sheet 55*a* is reversed in the direction of travel thereof and is conveyed toward the second nip 36.

The lower recording head 40b similarly operates to form an electrostatic latent image on the lower dielectric drum, that is, the second dielectric drum 31b. The electrostatic latent image is developed by the developing device 50b so that a second developed image is formed on the second drum 31b. This image is an image to be recorded on the back side, for example, of the recording sheet 55a. The developed image reaches the second nip 36 with the rotation of the second dielectric drum 31b, as shown in FIG. 8C. In the second nip 36, the second developed image is transferred from the second drum 31b onto the back side of the recording sheet 55a fed from the switch-back mechanism 60 in timed relation for alignment with the leading edge of the second image.

In this manner, the front and back sides of the recording sheet 55a receive the respective images in this embodiment. The start of the operation of the upper recording head 40a, that of the lower recording head 40b, the sheet feeding to the first nip 35 and the sheet feeding to the second nip 36 are so timed that each of the images is formed in the proper position of the recording sheet 55a.

As will be readily understood, this embodiment does not require the second supply tray 54b. Inversely, only the second supply tray 54b may be used, so that the images are transferred at the second nip.

In the foregoing embodiments, the image recorded on the recording sheet by the pressure transfer is the final image without image fixing operation. However, in order to enhance the fixation of the image, a known fixing device (not shown) may be used so as to fix the image after the pressure-transfer.

In the foregoing embodiments, only the pressure-transfer is performed at the nip between the dielectric drum and the transfer roller. It is possible that the pressure-fixing is effected simultaneously with the pressure-transfer. In this case, the pressure at the nip is preferably increased up to 100 kg/cm$^2$ or larger.

The descriptions about the image fixing apply also to the following embodiments.

Figure 9:
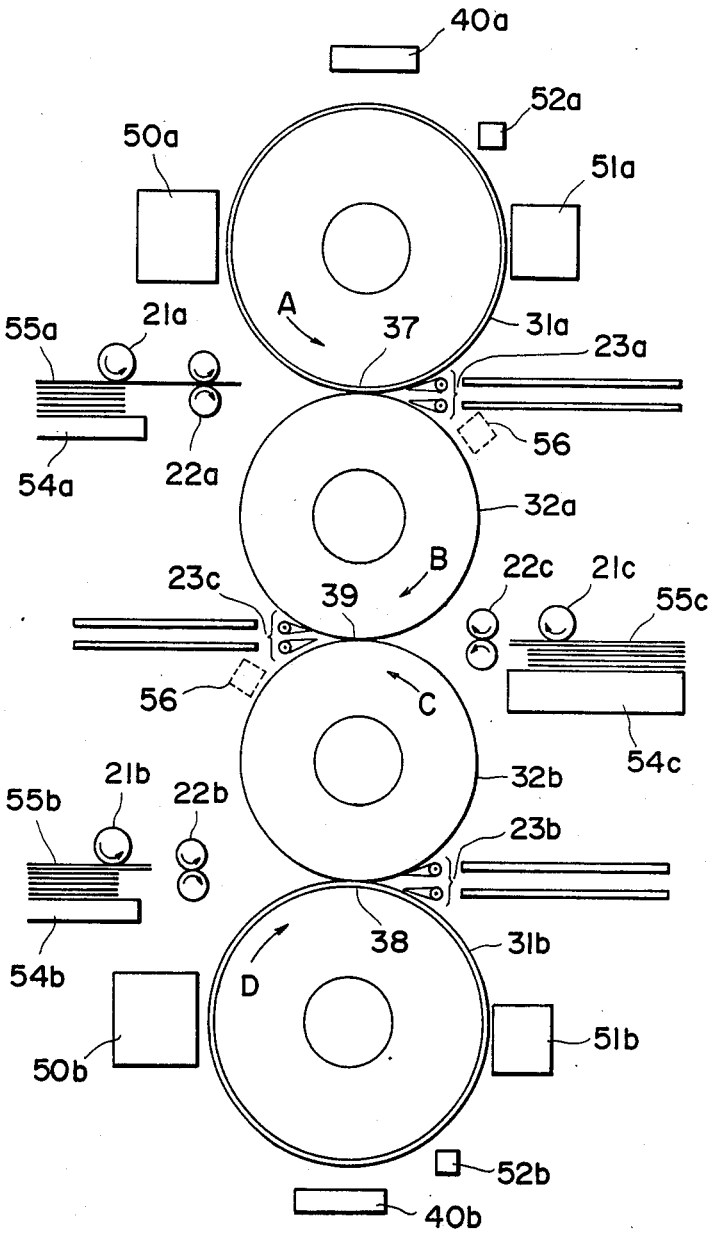
FIG. 9 is a sectional view of a basic structure of an image recording apparatus for various embodiments of the present invention.

FIG. 9 is a sectional view of an image recording apparatus having a basic structure for yet further embodiments of the present invention, wherein another transfer roller is employed in addition to the elements of FIG. 3 apparatus. The apparatus of this embodiment comprises mainly a first dielectric drum 31a, a second dielectric drum 31b, a first transfer roller 32a rollingly press-contacted to the first dielectric drum 31a and a second transfer roller 32b rollingly press-contacted to the first transfer roller 32a and the second dielectric drum 31b rollingly press-contacted to the second transfer roller 32b. The nips formed by the above-described points of contact are indicated by reference numerals 37, 38 and 39, respectively. The dielectric drums 31a and 31b and the transfer rollers 32a and 32b are of the same materials and structures as in the apparatus shown in FIG. 3. In this embodiment the dielectric drum 31a has the same diameter as the dielectric drum 31b, and the transfer roller 32a has the same diameter as the transfer roller 32b. The image processing means disposed around the drums 31a and 31b are similar to those of FIG. 3, so that the detailed explanation is omitted for the sake of simplicity by assigning the same or like reference numerals to the corresponding elements. In this embodiment, however, feeding rollers 21a, 21b and 21c, registration rollers 22a, 22b and 22c, and separation pawls 23a, 23b and 23c are provided. The developed image formed on the drum 31a is transferred by pressure onto a recording sheet 55a or onto the transfer roller 32a at the first nip 37, which will be described hereinafter. On the other hand, the developed image formed on the second drum 31b is transferred onto the recording sheet 55b or onto the second transfer roller 32b by pressure at the second nip 38. The first transfer roller 32a and the second transfer roller 32b are press-contacted with each other at the third nip 39, into which a recording sheet 55c is fed from a supply tray 54c.

As will become apparent from the decription hereinafter, some embodiments do not require some supply trays, for example, the supply tray 54a and the supply tray 54b.

The dielectric drum 31a, the transfer roller 32a, the transfer roller 32b and the dielectric drum 31b are resiliently displaceably supported so as to make smoother the insertion of the recording sheets to the nips.

Various embodiments of the present invention on the basis of the structure disclosed with FIG. 9 will be described. In the Figures of the following embodiments, the recording head, the developing device, the cleaning device, the discharger and so on are omitted since they are the same as shown in FIG. 9.

Figure 10A:
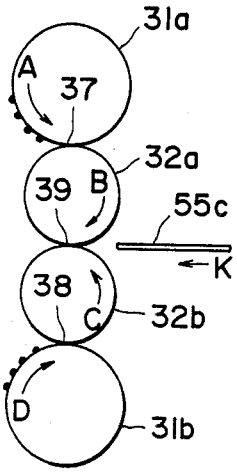
FIGS. 10A, 10B and 10C.
Figure 10B:
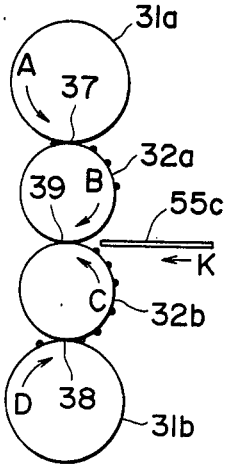
Figure 10C:
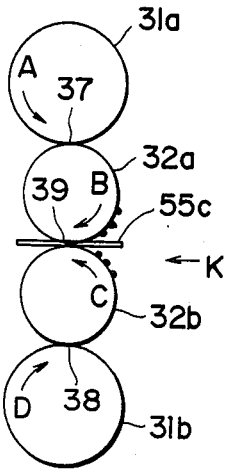

FIGS. 10A, 10B and 10C illustrate a first embodiment on the basis of structure shown in FIG. 9. In this embodiment, duplex recording can be effected, wherein images are simultaneously recorded on both sides of the recording sheet. The drums and the transfer rollers are rotated in the directions of the arrows A, B, C and D at the same peripheral speed as shown in the Figure.

The upper recording head 40a starts operating to form an electrostatic latent image on the upper dielectric drum, that is, the first dielectric drum 31a. The electrostatic latent image is developed by the developing device 50a so that a first developed image is formed on the first drum 31a. The image is an image to be recorded on the front side, for example, of the recording sheet 55c. The developed image reaches the first nip 37 with the continued rotation of the first drum 31a, as shown in FIG. 10A and is transferred by pressure onto the first transfer roller 32a. The first image now on the first transfer roller 32a reaches the third nip 39 with the continued rotation of the first transfer roller 32a (FIG. 10B).

On the other hand, the lower (first) recording head 40a starts, simultaneously with the start of the upper head 40a operation, operating to form a second electrostatic latent image on the lower (second) drum 31b. The second electrostatic latent image is developed by the developing device 50b so that a second developed image is formed on the second dielectric drum 31b. The image is an image to be recorded on the other side, that is, the back side, for example, of the recording sheet 55c. The second developed image reaches the second nip 38 with the continued rotation of the second drum 31b, as shown in FIG. 10B and is transferred by pressure onto the second transfer roller 32b. The second image now on the second transfer roller 32b reaches the third nip 39 with the continued rotation of the second transfer roller 32b.

Into the third nip 39, the recording sheet 55c is fed out of the supply tray 54c in the direction indicated by the arrow K. During the passage of the recording sheet 55c through the third nip 39, the images are transferred by pressure from the first transfer roller 32a and from the second transfer roller 32b onto the front side of the recording sheet 55c and onto the back side thereof, respectively (FIG. 10C).

In this manner, the front and back sides of the recording sheet 55c simultaneously receive the respective images in this embodiment. The start of the operation of the upper recording head 40a, that of the lower recording head 40b and the sheet feeding to the third nip 39 are so timed that each of the images is formed at the proper position of the recording sheet 54c. As will be readily understood, this embodiment does not require the first and second supply trays 54a and 54b.

According to this embodiment, duplex recording can be effected with a very simple passage for the recording sheet. Since the diameters of the drums are the same, and the diameters of the transfer rollers are the same, the image formations may be executed simultaneously.

Figure 11A:
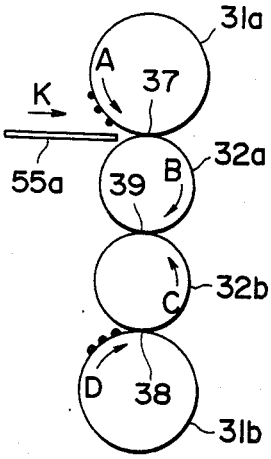
FIGS. 11A, 11B and 11C.
Figure 11B:
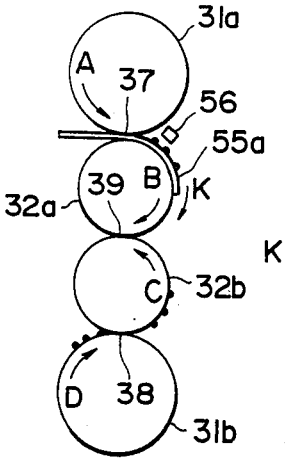
Figure 11C:
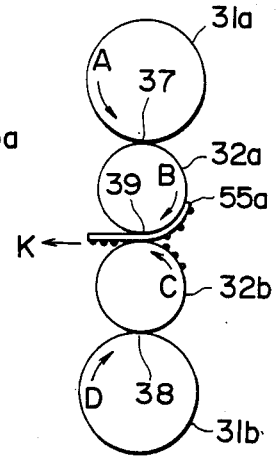

FIGS. 11A, 11B and 11C illustrate a second embodiment based on the structure of FIG. 9. In this embodiment, overprint recording can be effected, wherein images are superimposedly recorded on the same side of a recording sheet. The dielectric drums 31a and 31b and the transfer rollers 32a and 32b are rotated in the directions of the arrows A, B, C and D at the same peripheral speed.

The upper recording head 40b operates to form an electrostatic latent image on the upper dielectric drum, that is, the first dielectric drum 31a. The electrostatic latent image is developed by the developing device 50a so that a first developed image is formed on the first drum 31a. The image is a first image to be recorded on the front side, for example, of the recording sheet 55a. The developed image reaches the first nip 37 with the continued rotation of the first drum 31a as shown in FIG. 11A. In the nip 37, the first developed image is transferred by pressure onto the recording sheet 55a fed in the direction indicated by the arrow K in timed relation for alignment with the leading edge of the first developed image (FIG. 11B).

In this embodiment, the recording sheet 55a is gripped by or attracted to and supported on the first transfer roller 32a by a device 56 for mechanically or electrostatically holding and supporting the recording sheet 55a. Thus, the recording sheet 55a is carried on the surface of the first transfer roller 32 during the rotation thereof. On the other hand, the the start of the upper head 40a operation, operating to form a second electrostatic latent image on the lower drum, that is, the second drum 31b. The eleotrostatic latent image is developed by the developing device 50b so that a second developed image is formed on the second drum 31b. This image is a second image to be recorded on the same side, that is, the front side, for example, of the recording sheet 55a. The second developed image reaches the second nip 38 with the continued rotation of the second drum 31b as shown in FIG. 11B and is transferred by pressure onto the second transfer roller 32b. The image now on the second transfer roller 32b reaches the third nip 39 with the continued rotation of the second transfer roller 32 (FIG. 11B).

Into the third nip 39, the recording sheet 55a carried on or wrapped around the first transfer roller 32a is fed by the continued rotation of the first transfer roller 32a. During the passage of the recording sheet 55a through the third nip 39, the front side of the recording sheet 55a already having the first transferred image on that side, receives by the pressure-transfer the second developed image from the second transfer roller 32b.

In this manner, two images are superimposedly recorded on the same side of the recording sheet 55a, and the recording sheet 55a is discharged in this embodiment as a print having final images. The start of the operation of the upper recording head 40a, that of the lower recording head 40b and the sheet feeding to the first nip 37 are so timed that each of the images is formed at the proper position of the recording sheet 55a. As will be readily understood, this embodiment does not require the second and third supply trays 54b and 54c. Instead, only the second supply tray 54b may be used so that the overprint recording is effected at the nip 39.

As for a modification of this embodiment, the color of the first developing device 50a and that of the second developing device 50b may be made different, so that overprint recording in different two colors is possible.

In addition, by employing an unshown switchback mechanism which is effective to reverse the recording sheet 55a which has passed through the third nip 39 and transfer the same to the second nip 38, three-superimposed-image recording or a three-color superposed image may be formed.

FIGS. 12A, 12B, 12C and 12D illustrate a third embodiment based on the structure shown in FIG. 9. In this embodiment, the operations are the same as with FIGS. 11A–11C up to the stage where the superposed recording is accomplished in the third nip 39.

After the front side of the recording sheet 55a receives superimposedly the second image in the third nip 39, the recording sheet 55a is carried or wrapped about the second transfer roller 32b in the same manner as with the first transfer roller 32a. The lower recording head 40b restarts to form a third electrostatic latent image, which is developed similarly. The developed image reaches the second nip 38, where the third developed image is transferred onto the other side, that is, the back side of the transfer material 55a. The second image formation of the lower recording head 40b, the formation of the third image and the feeding of the recording sheet 55a to the second nip 38 are properly timed with each other.

According to this embodiment, the duplex recording is possible, and simultaneously, the overprint recording is possible on one of the sides.

Figures 13A, 13B, 13C:
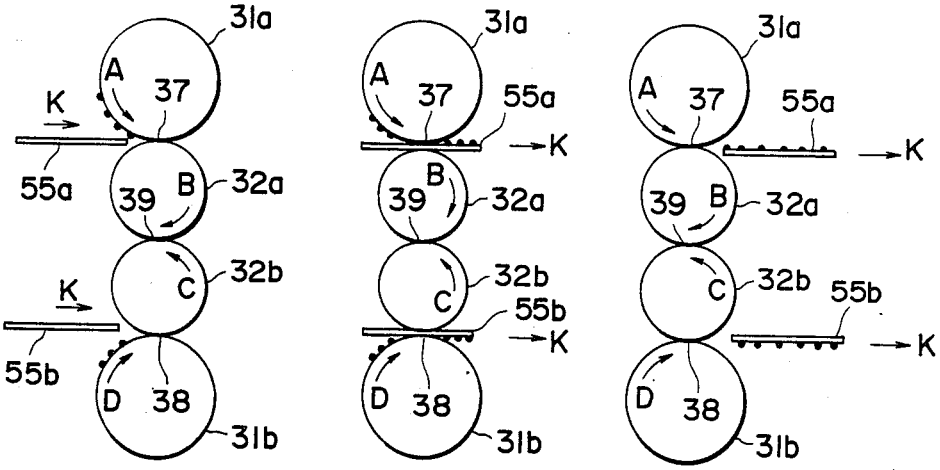
FIGS. 13A, 13B and 13C illustrate four other embodiments of the present invention, based on the structure shown in FIG. 9.

FIGS. 13A, 13B and 13C illustrate a fourth embodiment based on the structure shown in FIG. 9. In this embodiment, images are formed simultaneously on a recording sheet 55a and on a recording sheet 55b. The drums 31a and 31b and rollers 32a and 32b are rotated in the respective directions at the same peripheral speed. The upper recording head 40a operates to form a first electrostatic latent image on the upper drum, that is, the first drum 31a. The electrostatic latent image is developed by the developing device 50b so that a first developed image is formed on the first drum 31a. The image is an image to be recorded on one side of the recording sheet 55a. The developed image reaches the first nip 37 with the continued rotation of the first drum 31a, as shown in FIG. 13A. In the first nip 37, the developed image is transferred by pressure onto one side (the top side) of the first recording sheet 55a which is fed in the direction of arrow K in timed relation for alignment with the leading edge of the image on the first drum 31a (FIG. 13B).

In parallel with the above operations, the lower recording head 40b operates to form an electrostatic latent image on the lower drum, that is, the second drum 31*b*. The electrostatic latent image is developed by the developing device 50*b* so that a second developed image is formed on the second dielectric drum 31*b*. The image is an image to be recorded on one side of a second recording sheet 55*a*. The developed image reaches the second nip 38 with the continued rotation of the second drum 31*b* as shown in FIG. 13A. In the second nip 38, the image is transferred by pressure onto one side (the bottom side) of the second recording sheet 55*b* fed in the direction of arrow K in timed relation with the leading edge of the image on the second drum 31*b* (FIG. 13B).

According to this embodiment, the recording operations are simultaneously performed on the respective recording sheets 55*a* and 55*b* at the two nips 37 and 38, so that the image processing capability is enhanced, which increases the overall speed of image recording.

In the typical operation mode of this embodiment, the recording heads 40*a* and 40*b* are simultaneously operated, and the recording sheets 55*a* and 55*b* are fed simultaneously to the respective nips. It is possible, however, that the dielectric drums 31*a* and 32*b* and the transfer rollers 32*a* and 32*b* are continuously rotated, and the recording heads 40*a* and 40*b* are operated without timed relation with each other. In this case, the recording sheets are fed in timed relation with the formation of the image by the respective recording heads. Thus, the image recording operations are executed independently from each other at the nips. Since the recording operations are carried out at two positions, the image processing capability is improved.

The information given to the recording head 40*a* and that to the recording head 40*b* may be the same or different.

Figure 14:
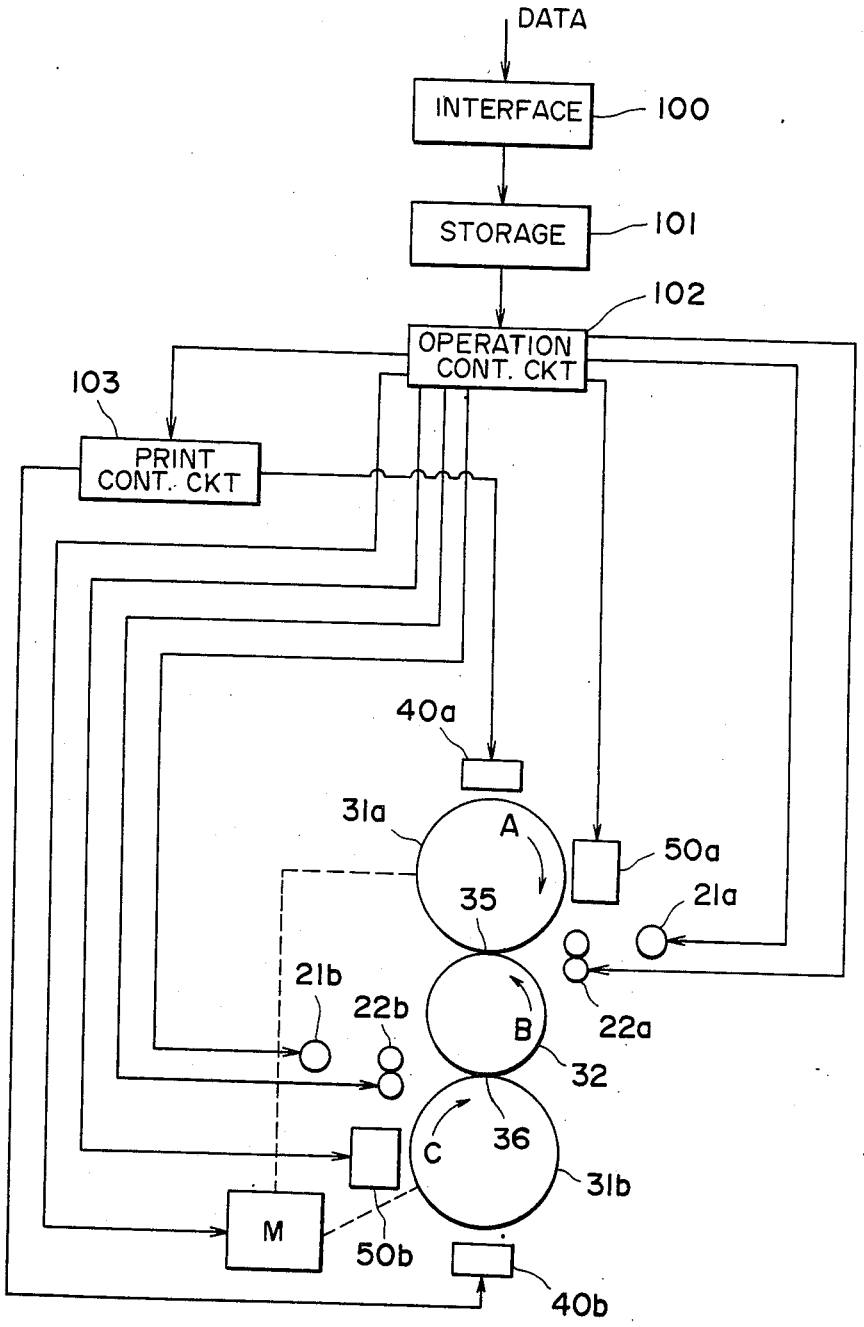
FIG. 14 is a block diagram illustrating operation of the apparatus based on the structure shown in FIG. 3.
Figure 15A:
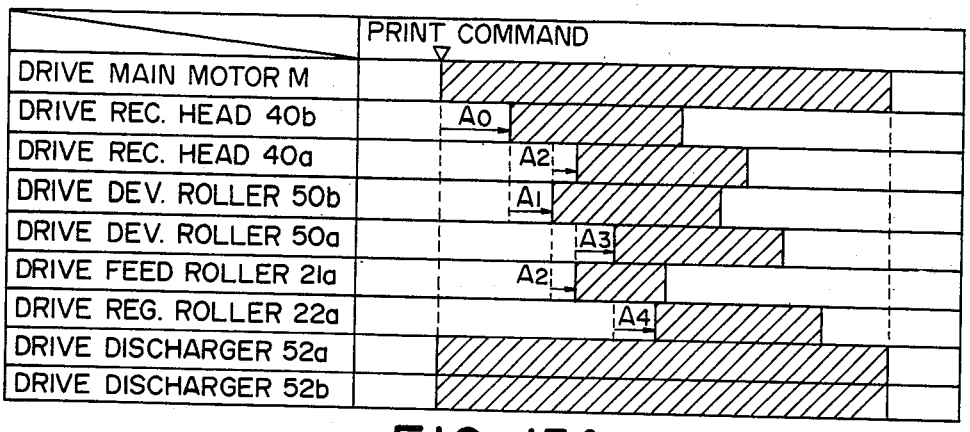
FIGS. 15A, 15B and 15C show timing charts for the operation of the apparatuses based on the structure shown in FIG. 3.
Figure 15B:
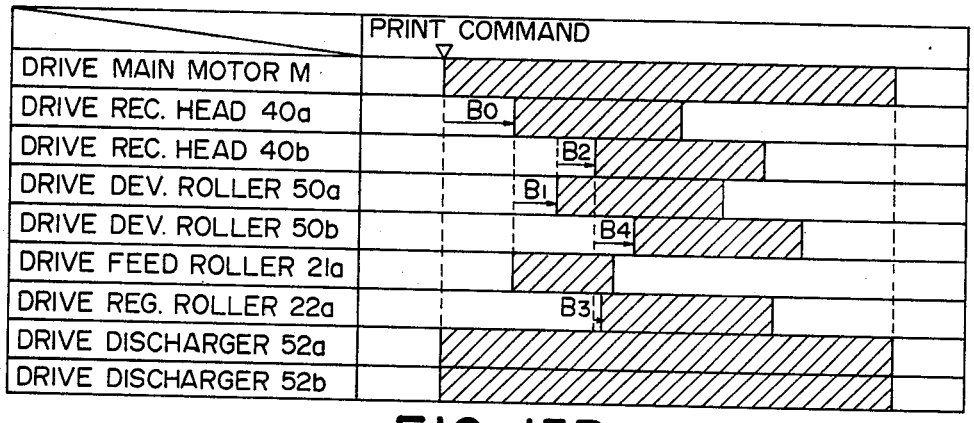
Figure 15C:
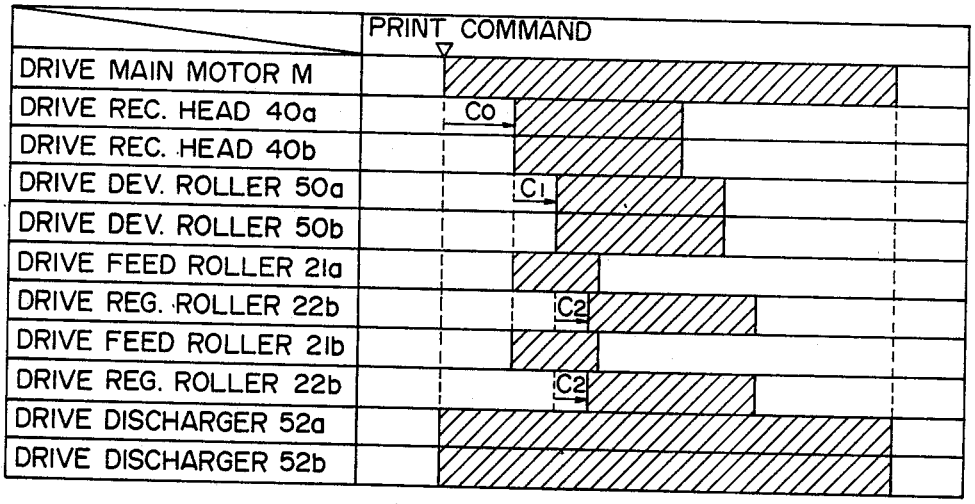

Referring now to FIGS. 14, 15A, 15B and 15C, the control of the image recording with FIG. 3 apparatus will be described in detail. In FIGS. 15A–15C, the hatched portion indicates that the associated means is in operation.

As shown in the block diagram of FIG. 14, the image recording apparatus of this embodiment receives data signals from the output port of an electronic computer or an image reader, and store the data signals in a storage 101 through an interface 100 of the image recording apparatus. The data signals are controlled also between the output port of the external apparatus and the interface 100 of the image recording apparatus. The data signals stored in the storage 101 are transmitted to an operation control circuit 102 and to the recording heads 40*a* and 40*b* through a print signal control circuit 103. In response thereto, electrostatic latent images are formed on the dielectric drum 31*a* and 31*b* in accordance with the image signal. The operation control circuit 102 controls the operations of the main motor M, the developing rollers of the developing devices 50*a* and 50*b*, the feeding rollers 21*a* and 21*b* and registration rollers 22*a* and 22*b*. When the printing instructions are produced by the external apparatus to the operation control circuit 102 through the interface 100 of the image recording apparatus, the control circuit 102 actuates the main motor M. Then, the dielectric drums 31*a* and 31*b* start rotating, and a microcomputer contained in the operation control circuit 102 starts counting in synchronism with rotation of the dielectric drums in this embodiment, predetermined clock pulse signals which are produced in response to one full rotation of the drum; and on the basis of the count of such clock pulses, the latent image formation on the drum, the developing action for the latent image, the feeding of the recording sheet to the nip between the dielectric drum and the transfer roller and another operation are controlled.

Referring to the timing chart of FIG. 15A, the latent image formation, development and the recording sheet feeding will be explained with respect to the embodiment described in conjunction with FIGS. 5A, 5B and 5C.

Upon the print instructions received by the operation control circuit 102, the main motor M starts so as to rotate the dielectric drums 31*a* and 31*b*. Simultaneously, the dischargers 52*a* and 52*b* are energized so that they are kept in operation during rotation of the dielectric drums. The recording head 40*b* for forming the electrostatic latent image on the dielectric drum 31*b* is driven when the image signal is transmitted thereto after the print instruction. The number of clock pulses produced from the time of print instructions to the input of the image signal is indicated by $A_0$ which may be any given number. Once $A_1$ clock pulses have been produced after the start of the recording head 40*b*, the developing roller of the developing device 50*b* starts its rotation. The number $A_1$ of the clock pulses is so predetermined that the developing roller starts rotating just before the leading edge of the latent image formed by the recording head 40*b* arrives at the developing device 50*b*.

The other recording head, that is, the recording head 40*a*, starts upon $(A_1+A_2)$ clock pulses produced after the start of operation of the recording head 40*b*, namely upon $A_2$ clock pulses after the start of the developing roller of the developing device 50B. The number $A_2$ of the clock pulses is so predetermined that the leading edge of the latent image formed by the recording head 40*b* is in alignment with the leading edge of the latent image formed by the recording head 40*a*, in the nip 35. Simultaneously with the start of the recording head 40*a*, the feeding roller 21*a* is actuated to feed the recording sheet 55*a* out of the supply tray 54*a*. The leading edge of the recording sheet 55*a* abuts the registration roller 22*a* so that the leading portion of the recording sheet 55*a* is curled between the feeding roller 21*a* and the registration roller 22*a*. When $A_3$ clock pulses have been generated after the start of the recording head 40*a*, the developing roller of the developing device 50*a* starts its rotation. The number $A_3$ of the clock pulses is determined in the same manner as with the number $A_1$ of the clock pulses. When $A_4$ clock pulses have been produced after the start of the developing roller 50*a*, the registration roller 22*a* starts so as to align the leading edge of the recording sheet 55*a* with the leading edge of the developed image formed on the dielectric drum 31*a*, in the nip 35. Because of the rotation of the registration roller 22*a*, the recording sheet 55*a* in the form of a curl is advanced to the nip 35*a*. By operating the various elements in the timed relation with each other as described above, the duplex recording can be properly executed.

In FIG. 15A, one duplex image recording is illustrated. When plural duplex recordings are to be performed, the same operation is repeated in response to generation of image signal. In the following examples, only one recording is explained similarly.

Referring to FIG. 15B, the control of the image recording operation will be explained with respect to the embodiment described with reference to FIGS. 6A–6C. In this embodiment, when the image signal is inputted $B_0$ clock pulses after the print instructions ($B_0$ may be any given number), the recording head 40*a* is driven, and simultaneously, the feeding roller 21*a* starts rotating. Then, the latent image is formed on the dielectric drum 31*a*, and the recording sheet 55*a* is supplied from the supply tray 54*a* by the feeding roller 21*a*. The leading edge of the recording sheet 55*a* abuts the registration roller 22*a* and stops there. $B_1$ clock pulses after the start of the recording head 40*a*, the developing roller of the developing device 50*a* starts, so that the latent image formed on the dielectric drum 31*a* by the recording head 40*a* is developed. In this embodiment, the developed image is transferred to the recording sheet 55*a* at the nip 35, and thereafter, the recording sheet 55*a* is wrapped around the transfer roller 32 and is carried thereon. The recording sheet 55*a* reaches the nip 36, where the developed image formed on the dielectric drum 31*b* and is transferred onto the same surface of the recording sheet 55*a* as has the image transferred from the dielectric drum 31*a*. The recording head 40*b* is driven to form the latent image on the dielectric drum 31*b* $B_2$ clock pulses after the rotation start of the developing roller in the developing device 50*a*. The number $B_2$ of the clock pulses is so determined that the latent image formed on the dielectric drum 31*b* is in alignment, at the nip 36, with the leading edge of the recording sheet 55*a* carried on the transfer roller 32.

$B_3$ clock pulses after the start of the recording head 40*b*, the registration roller 22*a* starts so that the leading edge of the developed image on the dielectric drum 31*a* is in alignment, at the nip 35, with the leading edge of the recording sheet 55*a*. The developing roller of the developing device 50*b* starts upon $B_4$ clock pulses after the start of the recording head 40*b*, and develops the latent image formed on the dielectric drum 31*b*. The numbers $B_1$ and $B_4$ of the clock pulses are so predetermined that the developing rollers of the respective developing devices start rotating just before the latent images on the associated dielectric drums arrive at the respective developing devices.

By operating various elements in the manner described above, overprint recording can be executed.

Referring now to FIG. 15C, the control of the image recording in the embodiment described with reference to FIGS. 7A–7C will be described. In this embodiment, when the image signal is inputted $C_0$ clock pulses from the time of generation of the print instruction ($C_0$ may be any given number), the recording heads 40*a* and 40*b* are driven, whereupon the latent image forming operations start on the dielectric drums 31*a* and 31*b*. In synchronism therewith, the feeding rollers 21*a* and 21*b* start so that the recording sheets 55*a* and 55*b* are fed out of the respective supply trays 54*a* and 54*b*. The leading edges of the recording sheets 55*a* and 55*b* abut the respective registration rollers 22*a* and 22*b*, whereby the recording sheets stop at the respective registration rollers.

The developing rollers of the developing devices 50*a* and 50*b* start rotating upon $C_l$ clock pulses after the start of the recording head 40*a* and 40*b*. The number $C_1$ of the clock pulses is so determined that the respective developing rollers start just before the leading edges of the latent image on the dielectric drums arrive at the associated developing devices 50*a* and 50*b*.

$C_2$ clock pulses from the start of the developing rollers of the developing devices 50*a* and 50*b*, the registration rollers 22*a* and 22*b* start so as to feed the recording sheets 55*a* and 55*b* to the respective nips 35 and 36. The number $C_2$ of the clock pulses is so predetermined that the leading edge of the developed image on the dielectric drums 31*a* and 31*b* are in alignment, at the respective nips 35 and 36, with the leading edges of the recording sheets 55*a* and 55*b*, respectively.

By operating various elements in the manner described above, the images are recorded on the respective recording sheets 55*a* and 55*b* at the nips 35 and 36, simultaneously.

In the foregoing, the control of operation, particularly, the timed relations among the various elements, have been described with respect to the embodiments on the basis of the construction shown in FIG. 3.

Although not illustrated in FIGS. 15A–15C, the separating pawls 23*a* and 23*b* are controlled by the control circuit. More particularly, in the embodiment illustrated in FIGS. 5A–5C, the separation pawl 23*a* takes such a position as to prevent the recording sheet 55*a* from wrapping around the dielectric drum 31*a* or the transfer roller 32.

For the embodiment of FIGS. 6A–6C, the separation pawl 23*a* prevents the recording sheet 55*a* from wrapping around the drum 31*a*, and the separation pawl 23*b* prevents recording sheet 55*a* from wrapping around the drum 31*b* or the transfer roller 32. In the embodiment of FIGS. 7A–7C, the separation pawl 23*a*prevents the recording sheet 55*a* from wrapping around the dielectric drum 31*a* or the transfer roller 32, while the separation pawl 23*b* prevents the recording sheet 55*b* from wrapping around the dielectric drum 31*b* or the transfer roller 32.

As for the embodiment illustrated in FIGS. 8A–8C, a detailed description of the control has not been provided since it will be readily understood in view of the controls described above with respect to the various embodiments, with the exception that the feeding of the recording sheet 55*a* from the switch back mechanism 60 is so controlled that the leading edge of the recording sheet 55*a* is in alignment, at the nip 36, with the leading edge of the developed image formed on the dielectric drum 31*b*. The operations of the separating pawls 23*a* and 23*b* in this embodiment are similar to the case of the embodiment of FIGS. 7A–7C.

The control of the means 56 for mechanically or electrostatically wrapping the recording sheet around the transfer roller is not particularly illustrated, but it will be readily understood that this means 56 is controlled by the control circuit.

This applies to the description with respect to the FIG. 9 embodiment which will be made in the following.

Figure 16:
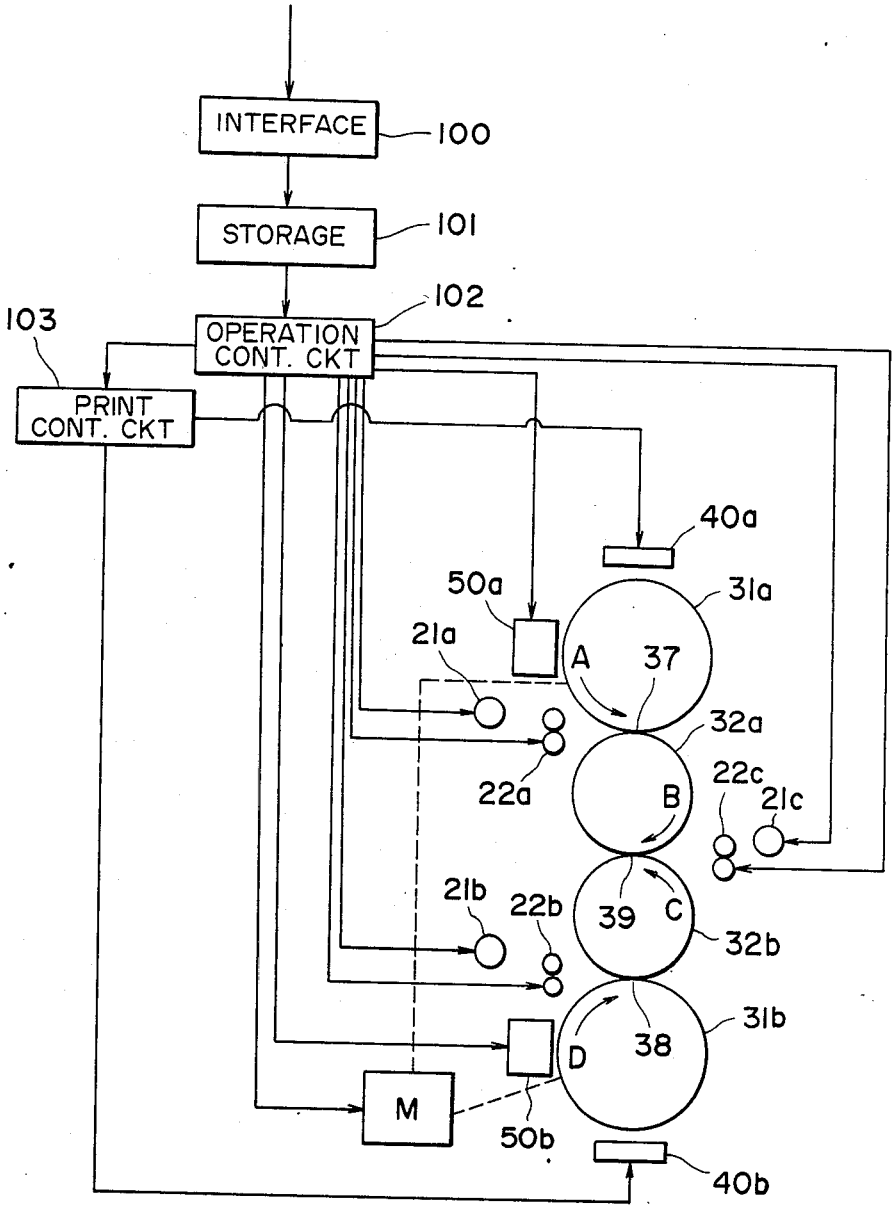
FIG. 16 is a block diagram illustrating operation of the apparatus based on the structure shown in FIG. 9.
Figure 17A:
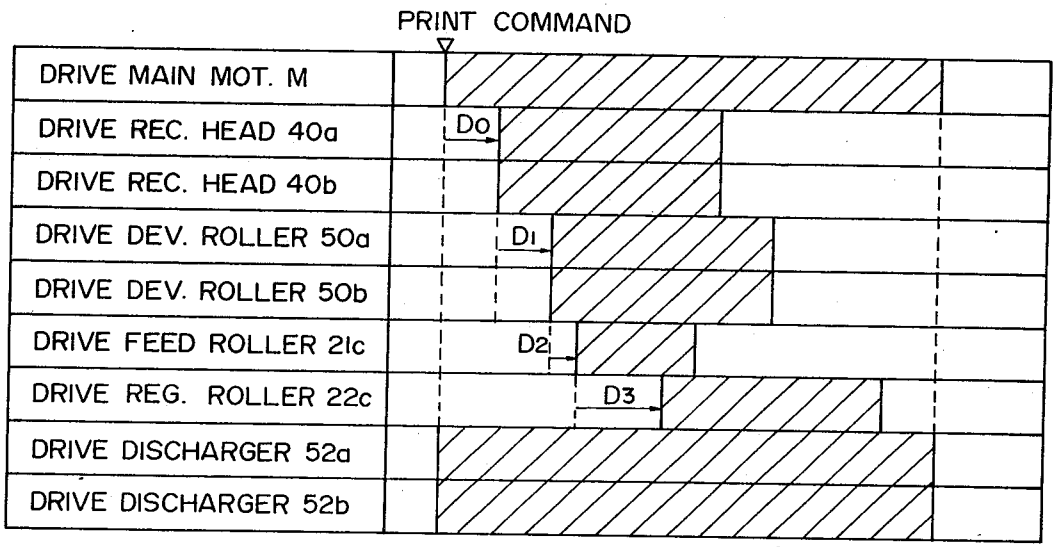
FIGS. 17A, 17B and 17C show timing charts for the operation of the apparatuses based on the structure shown in FIG. 9.
Figure 17B:
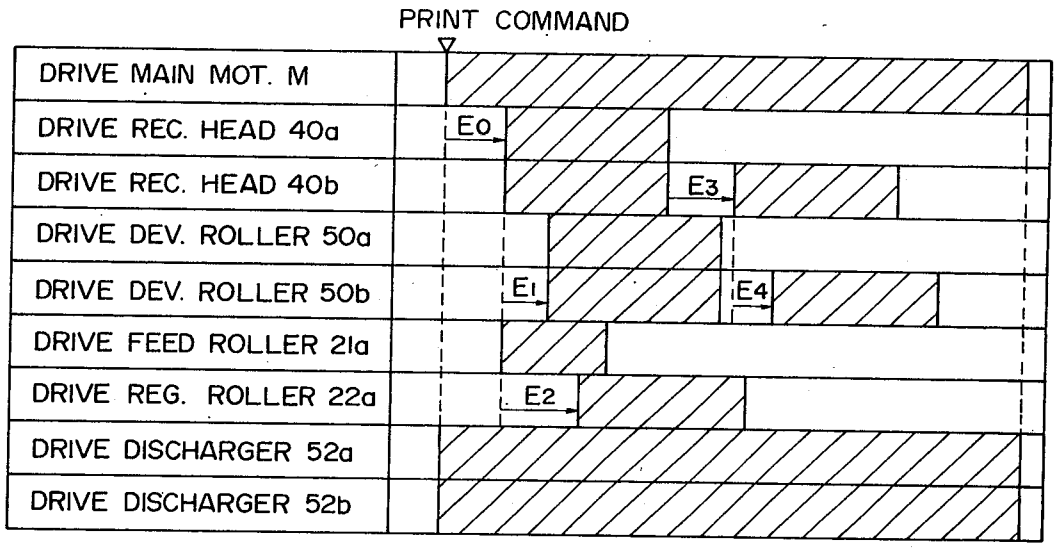
Figure 17C:
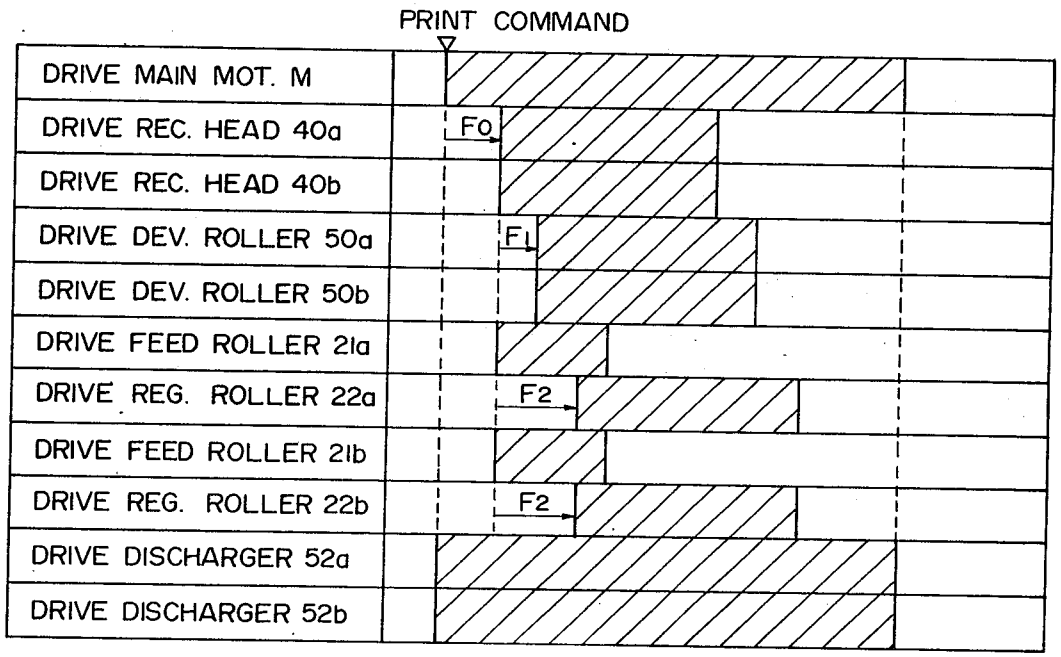

Referring to FIGS. 16, 17A, 17B and 17C, the control of the image recording operation in the FIG. 9 embodiment will be described. In FIGS. 17A–17C, the hatched portions indicate that the associated means is in operation.

FIG. 16 is a block diagram, wherein the control operations are essentially the same as with FIG. 14 with the exception of the operation control circuit 102 further controlling the feeding roller 21*c* and the registration roller 22*c*. FIG. 17A illustrates the control of the image recording operation in the embodiment which has been illustrated with FIGS. 10A–10C. When the image signal is inputted $D_0$ pulses generated from the point of time when the print instructions are generated (the number $D_0$ may be any given number), the recording heads 40*a* and 40*b* start operating so as to form the electrostatic latent images on the dielectric drums 31*a* and 31*b*, respectively. $D_1$ clock pulses after start of the recording head 40*a* and 40*b*, the developing rollers of the developing devices 50*a* and 50*b* start rotating. The number $D_1$ of the clock pulses is so determined that the developing rollers start rotating just before the leading edges of the latent images on the drums 31*a* and 31*b* arrive at the associated developing devices 50*a* and 50*b*. With the rotation of the developing rollers of the developing devices 50*a* and 50*b*, the latent images on the dielectric drums 31*a* and 31*b* are developed. The respective developed images are transferred onto the transfer rollers 32*a* and 32*b* at the nips 37 and 38, respectively. The developed images now carried on the transfer rollers 32*a* and 32*b* are advanced to the nip 39.

$D_2$ pulses after the start of the developing roller rotations of the developing devices, the feeding roller 21*c* is driven so that the leading edge of the recording sheet 55*c* is in alignment, at the nip 39, with the leading of the developed images. Due to the start of the feeding roller 21*c* rotation, the recording sheet 55*c* is fed out of the supply tray 55c. The recording sheet 55*c* abuts the registration roller 22*c* to form a curl. Upon $D_3$ clock pulses from the time of the rotation start of the feeding rollers 21*c*, the registration roller 22*c* starts rotating to feed the recording sheet 55*c* to the nip 39.

By operating various means in the timed relations with each other in the manner described above, the images are formed on both sides of the recording sheet 55*c*.

Referring now to FIG. 17B, the description will be made with respect to the control of the image recording operation in the apparatus of FIGS. 11A–11C and the apparatus of FIGS. 12A–12D. The embodiment of FIGS. 11A–11C will first be described. When the image signal is inputted $E_0$ clock pulses from the time of the print instructions generation ($E_0$ may be any given number), the recording heads 40*a* and 40*b* start operating, so as to form the electrostatic latent images on the dielectric drums 31*a* and 31*b*, respectively. $E_1$ clock pulses after the start of the recording heads 40*a* and 40*b*, the developing rollers of the developing devices 50*a* and 50*b* start rotating to develop the respective latent images. The number $E_1$ of the clock pulses is predetermined in the same manner as with the number $D_1$ of clock pulses in the case of FIG. 17A.

The feeding roller 21*a* starts rotating simultaneously with the start of the recording heads 40*a* and 40*b*. Upon $E_2$ clock pulses after the start of the feeding roller 21*a*, the registration roller 22*a* starts so that the leading edge of the developed image on the dielectric drum 31*a* is in alignment, at the nip 37 with the leading edge of the recording sheet 55*a*. Thus, the recording sheet 55*a* is advanced toward the nip 37.

In the nip 37, the recording sheet 55*a* receives on one of its surfaces the developed image from the dielectric member 31*a*, while wrapping about the transfer roller 32*a*. Simultaneously, the developed image formed on the dielectric drum 31*b* is being transferred onto the transfer roller 32*b* by pressure. Finally, the recording sheet 55*a* wrapped about the transfer roller 32*a* receives at the nip 39 the developed image superimposedly from the transfer roller 32*b*. In this manner, the overprint recording is performed.

Figures 12A, 12B, 12C, 12D:
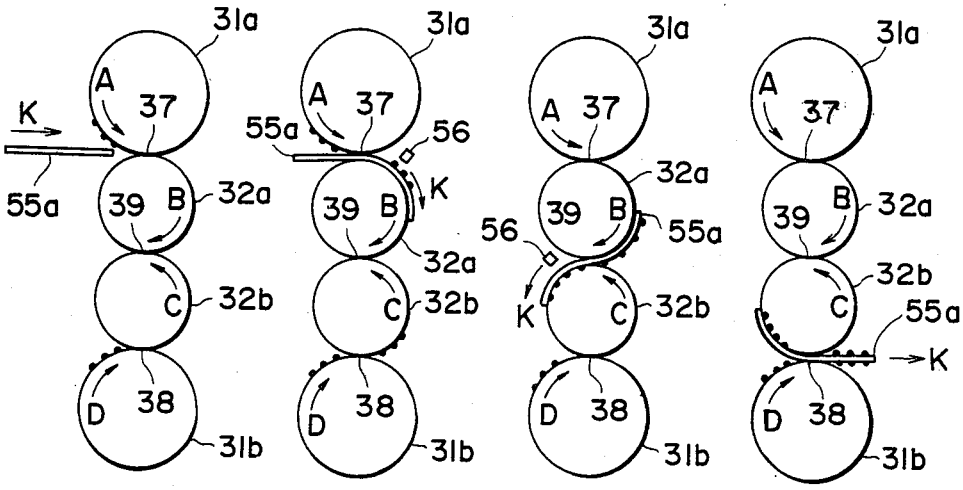
FIGS. 12A, 12B, 12C and 12D.

With respect to FIGS. 12A–12D, the recording sheet 55*a* is further wrapped about the transfer roller 32B, as shown in FIG. 12C. In this embodiment, operations are the same up to the stage where the superimposed image is formed at the nip 39. After the superposed image formation, the recording sheet 55*a* is further wrapped about the transfer roller 32*b*. The recording head 40*b* is restarted $E_3$ clock pulses after the stop of the recording head 40*b*, so that the second electrostatic latent image is formed on the dielectric drum 31*b*. The timing of the restart of the recording head 40*b* is so determined that the leading edge of the recording sheet 55*a* having the superimposed image and wrapped about the transfer roller 32*b* is in alignment, at the nip 38, with the leading edge of the second image on the dielectric drum 31*b*.

When the recording head 40*b* forms the second image, it receives from the print control circuit 103 predetermined image signals. $E_4$ clock pulses from the time of the recording head 40*b* restart (the number $E_4$ of the clock pulses may be the same as number $E_1$ of the clock pulses), the developing roller of the developing device 50*b* starts rotating to develop the latent image. While the recording sheet 55*a* carried on the transfer roller 32*b* passing through the nip 38, the developed image is transferred onto the other side of the recording sheet 55*a* so that a duplex print is provided.

Referring to FIG. 17C, the control of the image recording operation in the embodiment illustrated with FIGS. 13A–13C will be described. When the image signal is inputted $F_0$ clock pulses from the time of print instruction generation ($F_0$ may be any number), the recording heads 40*a* and 40*b* start operating so as to form the electrostatic latent images on the dielectric drums 31*a* and 31*b*. $F_1$ clock pulses from the time of the start of the recording heads, the developing rollers of the developing devices 50*a* and 50*b* start rotating so as to develop the latent images.

On the other hand, the feeding rollers 21*a* and 21*b* start simultaneously with the start of the recording heads 40*a* and 40*b*. $F_2$ clock pulses after the feeding rollers 21*a* and 21*b* start rotating, the registration rollers 21*a* and 21*b* start so as to bring the leading edges of the developed images formed on the dielectric drums 31*a* and 31*b* into alignment at the respective nips 37 and 38 with the leading edges of the recording sheets 55*a* and 55*b*, respectively. Thus, the recording sheets 55*a* and 55*b* are advanced simultaneously to the respective nips 37 and 38, whereby the developed images on the dielectric drums 31*a* and 31*b* are transferred by pressure onto the recording sheets 55*a* and 55*b* on the respective one side thereof.

In the foregoing, the control, particularly the timed relations among various elements are explained with respect to the embodiments based on the structures shown in FIG. 9. Although not particularly point out in the description of each of the embodiments, the dischargers 52*a* and 52*b* are operated in synchronism with the drive of the main motor M so that they are kept energized during the rotation of the associated dielectric drums.

Although not illustrated in the Figures, the separating pawls 23*a*, 23*b* and 23*c* are controlled by the operation control circuit 102 in this embodiment. In FIGS. 10A–10C, the separation pawl 23*c* takes such a position as to prevent the recording sheet 55*c* from wrapping about either of the transfer rollers 32*a* or 32*b*. In FIGS. 11A–11C, the separation pawl 23*a* prevents the recording sheet 55*a* from wrapping around the dielectric drum 31*a*, while the separation pawl 23*c* prevents the recording sheet 55*a* which has passed through the nip 39 from wrapping about the transfer roller 32*a* or the transfer roller 32*b*. In FIGS. 12A–12D, the separation pawl 23*a* prevents from the recording sheet 55*a* from wrapping around the dielectric drum 31*a*, and the separation pawl 23*c* prevents the recording sheet 55*a* which has passed through the nip 39 from wrapping around the transfer roller 32*a*, while the separation pawl 23*b* prevents the recording sheet 55*a* from wrapping around the dielectric drum 31*b* or the transfer roller 32*b*. In FIGS. 13A–13C, the separation pawl 23*a* prevents the recording sheet 55*a* from wrapping around the drum 31*a* or the transfer roller 23*a*, while the separation pawl 23*b* prevents the recording sheet 55*b* from wrapping around the dielectric drum 31*b* or the transfer roller 32*b*.

The apparatus of FIG. 3 may be such that it includes all of the means illustrated in FIG. 3, or in addition thereto, the switchback mechanism, and that it contains as selectively operable modes at least two of operations of FIGS. 5A–5C, FIGS. 6A–6C, FIGS. 7A–7C and FIGS. 8A–8C. In this case, a mode selector is provided, in response to which the above described control systems are controlled. Similarly, the apparatus of FIG. 9 may be such that it contains all of the means illustrated in FIG. 9, or in addition thereto, the switchback mechanism, and that it contains as selectively operable modes, at least two of the operations of the embodiments of FIGS. 10A–10C, FIGS. 11A–11C, FIGS. 12A–12D and FIGS. 13A–13C. In this case, a mode selector is provided, in response to which the above described contol systems are controlled.

Figure 1:
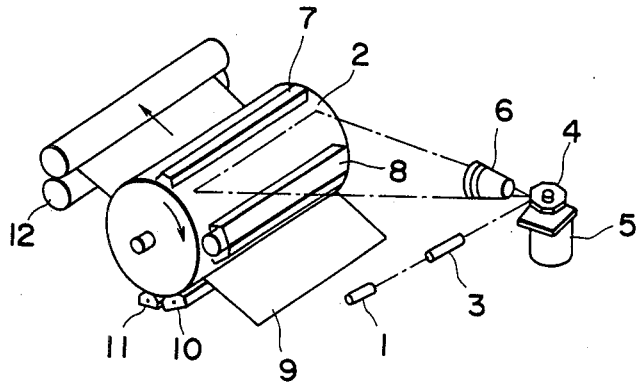
FIG. 1 PRIOR ART
FIG. 1 is a perspective view of a major part of a conventional electrophotographic apparatus.
Figure 2:
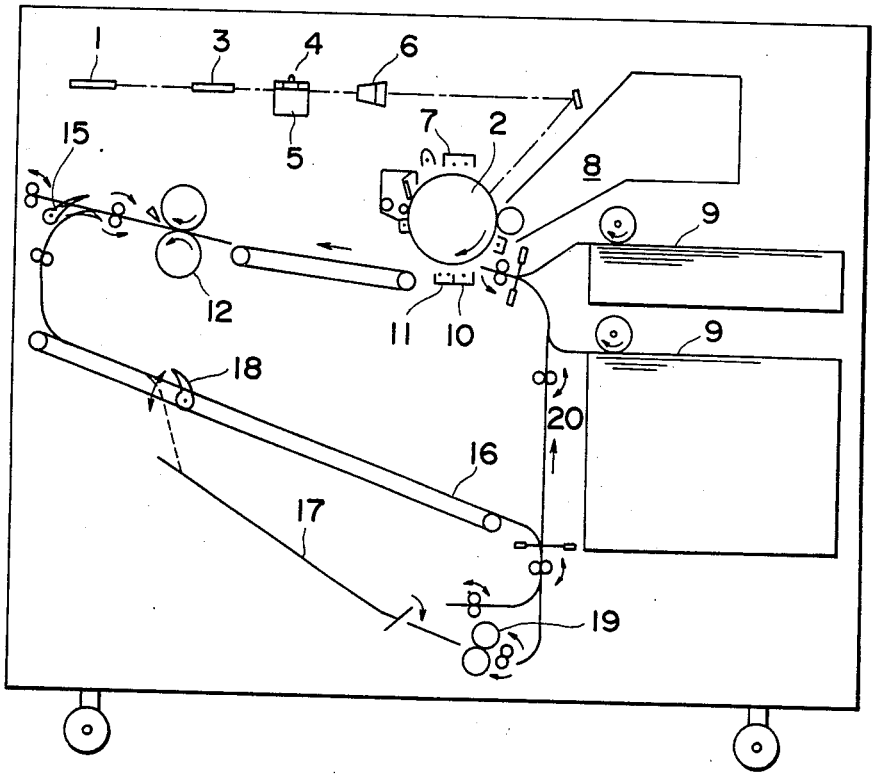
FIG. 2 PRIOR ART
FIG. 2 is a sectional view of the entirety of the electrophotograpic apparatus of FIG. 1.
Figure 18:
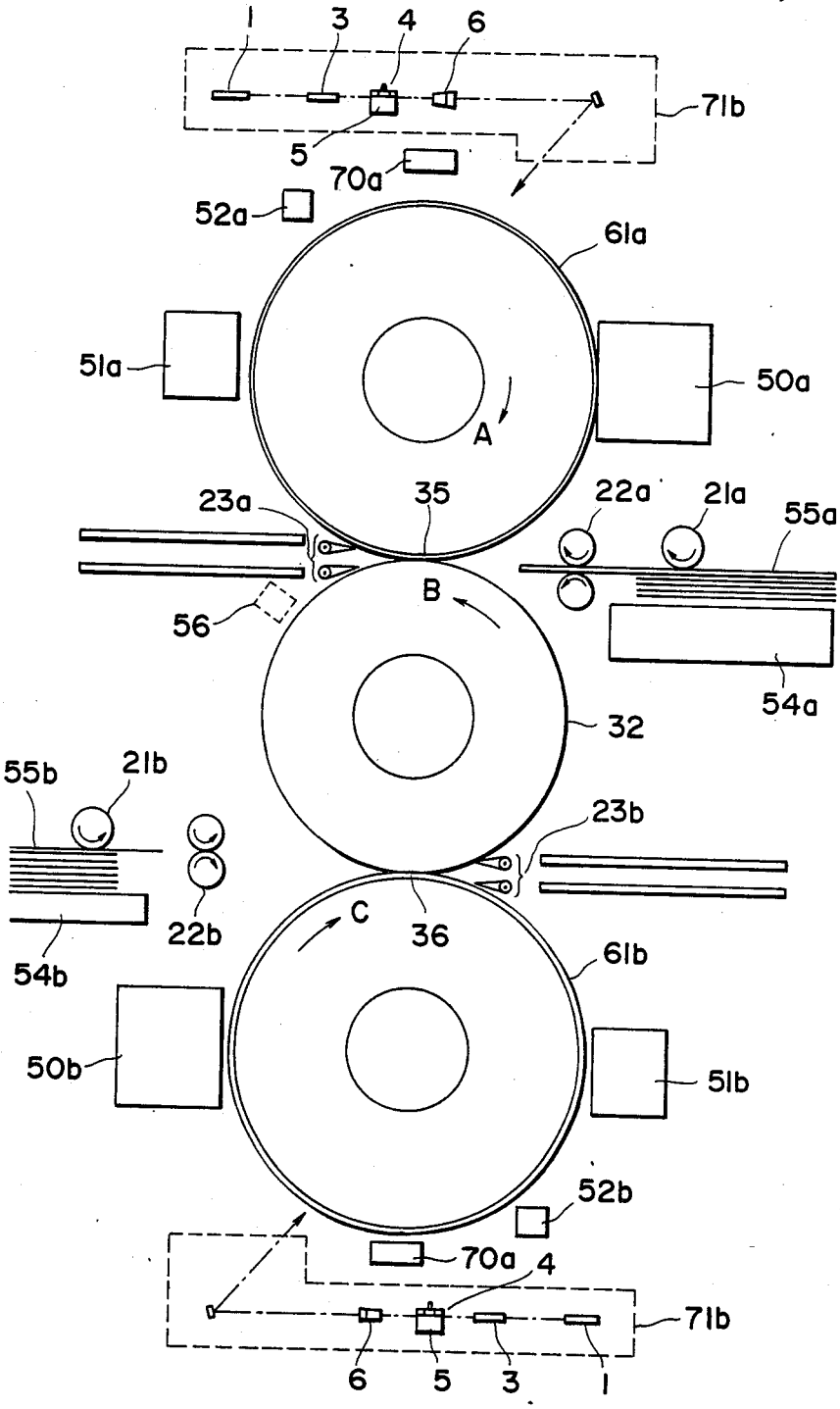
FIG. 18 is a sectional view of an image recording apparatus according to a further embodiment of the present invention.
Figure 19:
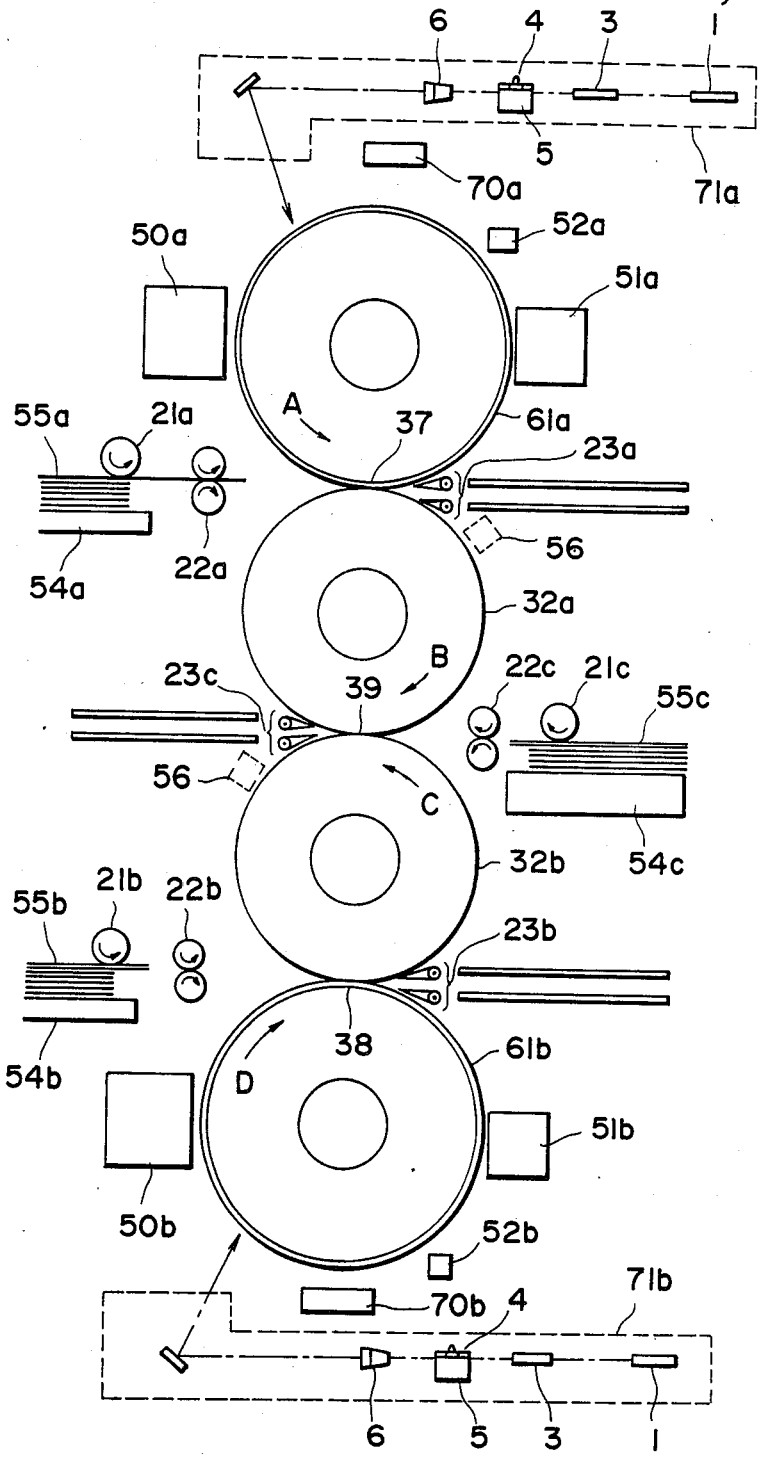
FIG. 19 is a sectional view of an image recording apparatus according to yet a further embodiment of the present invention.

FIGS. 18 and 19 illustrate further embodiments of the present invention. The embodiments described with FIGS. 3 and 9 use the dielectric drums as the latent image bearing members. The present embodiments use photosensitive drums 61*a* and 61*b* as the latent image bearing members. Each of the photosensitive drums may includes a rigid cylinder having a photoconductive surface layer of organic photoconductive (OPC), amorphous silicone photoconductor or amorphous selenium. Those embodiments employ, in place of the recording head of the preceding embodiments, an electrostatic latent image forming means comprising charging means 70*a* or 70*b* for uniformly charging the photosensitive drum 61*a* or 61*b*, and laser beam projecting means 71*a* or 71*b* for forming a latent image in accordance with the image signal on the uniformly charged photosensitive member. In those embodiments, the photosensitive drum is uniformly charged and exposed to the image light so that an electrostatic latent image is formed thereon. The laser beam projecting means may include the known means described in conjunction with FIGS. 1 and 2. As the latent image forming means, an array of LED or light shutter (liquid crystal shutter, for example) utilizing electric field birefringence effect are usable.

In any case, the electrostatic latent image formed on the photosensitive drum in the manner described above is developed into a visualized image, which is transferred by pressure onto the recording sheet or the transfer, and those steps are repeated; thus, the image recording similar to the techniques with dielectric drums are possible.

As described in the foregoing, according to the present invention, duplex recording, overprint recording and/or high speed recording is accomplished with simple passage for the recording sheet or sheets.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus, comprising:

a first movable latent image bearing member for bearing a latent image;

first latent image forming means for forming a latent image on said first latent image bearing member;

first developing means for developing the latent image formed by said first latent image forming means;

a second movable latent image bearing member for bearing a latent image;

second latent image forming means for forming a latent image on said second latent image bearing member;

second developing means for developing the latent image formed by said second latent image forming means; and means for transferring the images developed by said first and second developing means, said transferring means being common to said first and second latent image bearing members.

2. An apparatus according to claim 1, wherein said transferring means includes a rotatable member contacting both said first and said second latent image bearing members.

3. An apparatus according to claim 2, wherein said rotatable member is press-contacted to said latent image bearing members.

4. An apparatus according to claim 1, wherein said transferring means includes a first transfer station for transferring the developed image from said first latent image bearing member and a second transfer station for transferring the developed image from said second latent image bearing member, said apparatus further comprising means for supplying a recording material to said first transfer station and to said second transfer station.

5. An apparatus according to claim 2, wherein a nip is defined between said rotatable member and said second latent image bearing member, and wherein a first developed image formed on said first latent image bearing member is transferred onto said rotatable member, and wherein the first developed image on said rotatable member and a second developed image formed on said second latent image bearing member are simultaneously transferred onto respective sides of a recording material fed into said nip.

6. An apparatus according to claim 1, wherein said transferring means includes a first transfer station for transferring a first developed image from said first latent image bearing member and a second transfer station for transferring a second developed image from said second latent image bearing member, wherein a recording material is conveyed through said first transfer station, where it receives the first developed image, and then through said second transfer station, where it receives the second developed image.

7. An apparatus according to claim 6, wherein the recording material receives both the first and the second developed images on the same side of the recording material.

8. An apparatus according to claim 6, wherein the recording material receives the first and second developed images on first and second sides of the recording material, respectively.

9. An apparatus according to claim 1, wherein said first and second latent image bearing members are drumshaped, and are equal to each other in diameter.

10. An image forming apparatus, comprising:

a first rotatable latent image bearing member for bearing a latent image;

a second rotatable latent image bearing member for bearing a latent image;

latent image forming means for forming latent images on said latent image bearing members;

developing means for developing the latent images formed by said first and by said second latent image forming means;

a first rotatable transfer member; and a second rotatable transfer member, wherein said first transfer member forms a first nip with said first latent image bearing member and a second nip with said second latent image bearing member, and said second transfer member forms a third nip with said second latent image bearing member.

11. An apparatus according to claim 10, further comprising means for supplying a recording material into said first, second and third nips, at each of which nips an image can be transferred.

12. An apparatus according to claim 10, wherein a first developed image formed on said first latent image bearing member is transferred onto said first transfer member, and a second developed image formed on said second latent image bearing member is transferred onto said second transfer member, and then the first and second developed images are transferred onto respective sides of a recording material at said second nip.

13. An apparatus according to claim 10, further comprising means for supplying a recording material into said first nip, wherein the recording material receives on its first side a first developed image from said first latent image bearing member at said first nip, and thereafter, receives on its opposite side a second developed image from said second latent image bearing member.

14. An apparatus according to claim 10, further comprising means for supplying a recording material into at least two of said nips, and wherein an image can be transferred onto the recording material at each of said at least two nips.

15. An apparatus according to claim 10, wherein said latent image forming means forms the latent image by charging and exposing the latent image bearing member to image-wise light.

16. An apparatus according to claim 10, wherein said transfer members have same peripheral length.

* * * * *

UNITED STATES PATENT AND TRADEMARK OFFICE

CERTIFICATE OF CORRECTION

PATENT NO. : 4,674,857

DATED : June 23, 1987

INVENTOR(S) : HIROSHI SATOMURA, ET AL.

It is certified that error appears in the above-identified patent and that said Letters Patent is hereby corrected as shown below:

AT [57] IN THE ABSTRACT

Line 5, "members," should read --members--.

COLUMN 1

Line 52, "capability such" should read --capability, such--.

COLUMN 2

Line 14, "electrophotograpic" should read --electrophotographic--.

COLUMN 3

Line 8, "trophotograpic" should read --trophotographic--.
Line 16, "7C," should read --7C;--.

COLUMN 6

Line 9, "image is" should read --images--.
Line 44, "transfer drum" should read --transfer roller--.
Line 54, "undersood," should read --understood,--.

COLUMN 7

Line 14, "transfer drum" should read --transfer roller--.
Line 66, "side, of" should read --side of--.

UNITED STATES PATENT AND TRADEMARK OFFICE

CERTIFICATE OF CORRECTION

PATENT NO. : 4,674,857

DATED : June 23, 1987

INVENTOR(S) : HIROSHI SATOMURA, ET AL.

It is certified that error appears in the above-dentified patent and that said Letters Patent is hereby corrected as shown below:

COLUMN 8

Line 18, "tranferred" should read --transferred--.

COLUMN 10

Line 12, "decription" should read --description--.

COLUMN 11

Line 9, "54c." should read --55c.--.
Line 45, "the the" should read --the lower recording head 40b starts, simultaneously with the--.
Line 48, "eleotrostatic" should read --electrostatic--.

COLUMN 12

Line 17, "different two" should read --two different--.

COLUMN 13

Line 5, "55a." should read --55b.--.
Line 43, "store" should read --stores--.
Line 52, "drum" should read --drums--.

COLUMN 14

Line 19, "$A_0$ which" should read --$A_0$, which--.
Line 31, "50B." should read --50b.--.

UNITED STATES PATENT AND TRADEMARK OFFICE

CERTIFICATE OF CORRECTION

PATENT NO. : 4,674,857

DATED : June 23, 1987

INVENTOR(S) : HIROSHI SATOMURA, ET AL.

It is certified that error appears in the above-identified patent and that said Letters Patent is hereby corrected as shown below:

COLUMN 15

Line 30, delete "upon".
Line 56, "upon $C_1$" should read --$C_1$--.
Line 57, "head" should read --heads--.

COLUMN 16

Line 23, "23aprevents" should read --23a prevents--.
Line 67, "head" should read --heads--.

COLUMN 17

Line 62, "32B," should read --32b,--.

COLUMN 18

Line 16, "passing" should read --passes--.
Line 47, "point" should read --pointed--.

COLUMN 19

Line 24, "contol" should read --control--.
Line 31, "includes" should read --include--.
Line 54, "fer," should read --fer roller,--.

COLUMN 20

Line 65, "drumshaped," should read --drum-shaped,--.

UNITED STATES PATENT AND TRADEMARK OFFICE

CERTIFICATE OF CORRECTION

PATENT NO. : 4,674,857

DATED : June 23, 1987

INVENTOR(S) : HIROSHI SATOMURA, ET AL.

It is certified that error appears in the above-identified patent and that said Letters Patent is hereby corrected as shown below:

COLUMN 22

Line 22, "have same" should read --have the same--.

Signed and Sealed this

Tenth Day of May, 1988

*Attest:*

DONALD J. QUIGG

*Attesting Officer*

*Commissioner of Patents and Trademarks*